US012109666B2

(12) United States Patent
Sinzig et al.

(10) Patent No.: US 12,109,666 B2
(45) Date of Patent: Oct. 8, 2024

(54) QUICK CLAMPING DEVICE FOR A PORTABLE POWER TOOL, IN PARTICULAR AN ANGLE GRINDER, HAVING IN PARTICULAR AT LEAST ONE OUTPUT SHAFT THAT IS DRIVABLE IN ROTATION

(71) Applicant: Robert Bosch GmbH, Stuttgart (DE)

(72) Inventors: Bruno Sinzig, Oberbipp (CH); Andreas Zurbruegg, Luterbach (CH); Marcus Schuller, Dettenhausen (DE); Bruno Luescher, Zofingen (CH)

(73) Assignee: Robert Bosch GmbH, Stuttgart (DE)

( * ) Notice: Subject to any disclaimer, the term of this patent is extended or adjusted under 35 U.S.C. 154(b) by 1303 days.

(21) Appl. No.: 16/631,825

(22) PCT Filed: Jul. 31, 2018

(86) PCT No.: PCT/EP2018/070750
§ 371 (c)(1),
(2) Date: Jan. 16, 2020

(87) PCT Pub. No.: WO2019/030058
PCT Pub. Date: Feb. 14, 2019

(65) Prior Publication Data

US 2020/0164485 A1 May 28, 2020

(30) Foreign Application Priority Data

Aug. 11, 2017 (DE) ..... 10 2017 214 118.2

(51) Int. Cl.
*B24B 45/00* (2006.01)
*B24B 23/02* (2006.01)

(52) U.S. Cl.
CPC ..... *B24B 45/006* (2013.01); *B24B 23/022* (2013.01)

(58) Field of Classification Search
CPC ..... B24B 23/022; B24B 45/006
See application file for complete search history.

(56) References Cited

U.S. PATENT DOCUMENTS 3,233,908 A * 2/1966 Tietze ..... B23B 31/185 279/157
2002/0028644 A1* 3/2002 Rudolf ..... B24B 23/02 451/344

(Continued)

FOREIGN PATENT DOCUMENTS

CN 103338713 A 10/2013
CN 104010772 A 8/2014

(Continued)

OTHER PUBLICATIONS

International Search Report corresponding to PCT Application No. PCT/EP2018/070750, mailed Nov. 29, 2018 (German and English language document) (5 pages).

*Primary Examiner* — Joshua T Kennedy
(74) *Attorney, Agent, or Firm* — Maginot, Moore & Beck LLP

(57) ABSTRACT

A quick clamping device for a portable power tool, in particular an angle grinder, includes an output shaft that is configured to be driven in rotation and at least one clamping unit that is configured to fix an application tool unit to the output shaft without tools. The clamping unit has at least one movably mounted clamping element configured to apply a clamping force to the application tool unit in a clamping position of the clamping element. The clamping element is formed by a positive-locking element that is movable transversely to an axis of rotation of the output shaft and is configured to engage behind at least a subregion of the application tool unit in a positive-locking manner so as to secure the application tool unit.

6 Claims, 9 Drawing Sheets

(56) References Cited

U.S. PATENT DOCUMENTS

| | | | | |
|---|---|---|---|---|
| 2014/0110908 | A1* | 4/2014 | Fankhauser | A61B 17/142 279/141 |
| 2015/0042052 | A1* | 2/2015 | Furusawa | B23B 31/10 279/141 |
| 2015/0108725 | A1* | 4/2015 | Luescher | B24B 45/006 279/141 |
| 2016/0184956 | A1* | 6/2016 | Klabunde | B24B 23/04 279/4.01 |
| 2017/0057050 | A1* | 3/2017 | Montplaisir, Jr. | B27B 19/006 |
| 2018/0311746 | A1* | 11/2018 | Klabunde | B27B 5/32 |
| 2019/0262970 | A1* | 8/2019 | Luescher | B24B 45/006 |
| 2020/0039026 | A1* | 2/2020 | Luescher | B24B 45/006 |
| 2021/0252667 | A1* | 8/2021 | Kotsuji | B23B 31/10 |
| 2021/0276146 | A1* | 9/2021 | Zurbruegg | B27B 5/32 |

FOREIGN PATENT DOCUMENTS

| | | | | | |
|---|---|---|---|---|---|
| CN | 104159711 | A | | 11/2014 | |
| CN | 104220199 | A | | 12/2014 | |
| CN | 102785162 | B | * | 3/2015 | B23D 51/10 |
| CN | 105473282 | A | | 4/2016 | |
| DE | 87 11 311 | U1 | | 11/1987 | |
| DE | 100 17 458 | A1 | | 10/2001 | |
| DE | 10 2011 003 103 | A1 | | 7/2012 | |
| DE | 10 2012 004 458 | A1 | | 9/2013 | |
| DE | 10 2012 007 926 | A1 | | 10/2013 | |
| DE | 102012007931 | A1 | * | 10/2013 | B24B 23/022 |
| DE | 10 2012 211 096 | A1 | | 1/2014 | |
| DE | 20 2013 006 900 | U1 | | 12/2014 | |
| DE | 20 2013 006 901 | U1 | | 12/2014 | |
| JP | 50-8177 | A | | 1/1975 | |
| JP | 2016-529119 | A | | 9/2016 | |
| WO | WO-2013131676 | A2 | * | 12/2013 | B23B 31/18 |

* cited by examiner

QUICK CLAMPING DEVICE FOR A PORTABLE POWER TOOL, IN PARTICULAR AN ANGLE GRINDER, HAVING IN PARTICULAR AT LEAST ONE OUTPUT SHAFT THAT IS DRIVABLE IN ROTATION

This application is a 35 U.S.C. § 371 National Stage Application of PCT/EP2018/070750, filed on Jul. 31, 2018, which claims the benefit of priority to Serial No. DE 10 2017 214 118.2, filed on Aug. 11, 2017 in Germany, the disclosures of which are incorporated herein by reference in their entirety.

BACKGROUND

Already known from DE 100 17 458 A1 is a quick-change clamping device for a portable power tool, in particular a power angle grinder, having at least one output shaft that can be driven in rotation, having at least one clamping unit that, for the purpose of fixing an insert-tool unit to the output shaft without use of tools, has at least one movably mounted clamping element for applying a clamping force to the insert-tool unit when the clamping element is in a clamping position, and having at least one operating unit for moving the clamping element into the clamping position and/or into a release position of the clamping element, in which the insert-tool unit can be removed from the clamping unit and/or from the output shaft.

SUMMARY

The disclosure is based on a quick-change clamping device for a portable power tool, in particular for a power angle grinder, having at least one output shaft that can be driven in rotation, having at least one clamping unit that, for the purpose of fixing an insert-tool unit to the output shaft without use of tools, has at least one movably mounted clamping element for applying a clamping force to the insert-tool unit when the clamping element is in a clamping position.

It is proposed that the clamping element be formed by a positive-engagement element that is movable transversely in relation to a rotation axis of the output shaft and that is designed to engage with positive engagement behind at least a sub-region of the insert-tool unit for the purpose of securing the insert-tool unit. Preferably, for the purpose of securing the insert-tool unit, the clamping unit is designed to engage with positive engagement behind the insert-tool unit by a movement, directed at least partially radially in relation to a rotation axis of the output shaft, of at least a sub-section of the clamping element. Preferably, the quick-change clamping device additionally has at least one driving means that, for the purpose of transmitting a driving force to the insert-tool unit, has at least one torque transmission region spaced apart axially from a rotation axis of the output shaft. Preferably, for the purpose of directly applying clamping force to the insert-tool unit, the movably mounted clamping element is arranged in a clamping position of the clamping element. Particularly preferably, the clamping force is applied, in particular automatically, by the quick-change clamping device, such as, for example, by a spring element. Particularly preferably, the clamping element is in an operating state, without operator intervention in a clamping position. The clamping element can be brought into a release position, in particular by an operator intervention. Preferably, the clamping element is arranged, at least partly, in the output shaft. The output shaft is formed, in particular, by a hollow spindle. Preferably, the output shaft surrounds the clamping element at least partially, in particular completely, along a circumferential direction around a rotation axis of the output shaft. Preferably, the clamping element is connected to the output shaft in a rotationally fixed manner. Preferably, the clamping element is mounted so as to be swivelable about a swivel axis of the clamping element. Preferably, the swivel axis of the clamping element runs transversely, in particular at least substantially perpendicularly, in relation to the rotation axis of the output shaft. Preferably, the swivel axis of the clamping element runs at least substantially perpendicularly in relation to a clamping axis of the clamping unit. A "clamping axis" is to be understood here to mean, in particular, an axis of the clamping unit along which an axial securing force of the clamping unit can be exerted upon the insert-tool unit for the purpose of fixing the insert-tool unit to the output shaft, and/or along which a transmission element of the clamping unit is movably mounted for the purpose of moving the clamping element. "At least substantially perpendicularly" is intended here to define, in particular, an alignment of a direction relative to a reference direction, wherein the direction and the relative direction, in particular as viewed in one plane, enclose an angle of 90° and the angle has a maximum deviation of, in particular, less than 8°, advantageously less than 5°, and particularly advantageously less than 2°. Preferably, the clamping element is realized as a clamping jaw. Preferably, the clamping element is designed to secure the insert-tool unit axially to the output shaft. Preferably, the clamping element, at least in the clamping position, preferably engages, at least partially, in the insert-tool unit, in particular in a fixing recess of the insert-tool unit. Preferably, at least when the insert-tool unit has been fixed by means of the clamping unit, the clamping element engages behind a clamping extension of the insert-tool unit.

"Designed" is to be understood to mean, in particular, specially programmed, configured and/or equipped. That an element and/or a unit are/is designed for a particular function is to be understood to mean, in particular, that the element and/or the unit fulfill/fulfills and/or execute/executes this particular function in at least one application state and/or operating state. "Movably mounted" is to be understood to mean, in particular, a mounting of an element and/or of a unit, the element and/or the unit having a movement capability, in particular dissociated from an elastic deformation of the element and/or of the unit, along a movement axis, of more than 5 mm, preferably of more than 10 mm, and particularly preferably of more then 50 mm, and/or about a movement axis, along an angular range of more than 10, preferably of more than 5°, and particularly preferably of more than 15°. A "positive-engagement element that is movable transversely in relation to a rotation axis of the output shaft" in this context is to be understood to mean, in particular, a clamping element designed to produce a positive-engagement connection in at least one operating state, in particular in a clamping position. Preferably, the positive-engagement element has, within its movement range, at least one movement component that extends radially in relation to the rotation axis of the output shaft. "Engage with positive engagement behind" in this context is to be understood to mean, in particular, that at least a sub-section of the clamping element engages behind at least a sub-region of the insert-tool unit, in the axial direction of the rotation axis of the output shaft. Preferably, in an engaged-behind state, as viewed from an axial direction of the rotation axis of the output shaft, along a flow of force, the sub-section of the clamping element is at least partially concealed by the sub-region of the insert tool.

Owing to the design of the quick-change clamping device according to the disclosure, securing of the insert-tool unit can be achieved, in particular, in an advantageously safe and simple manner. In particular, it is possible to achieve reliable securing of the insert-tool unit, by positive engagement, in transmission housing unit axial direction. An advantageously high degree of operating convenience can be achieved as a result. In particular, fixing of the insert-tool unit can be achieved in an advantageously convenient and safe manner, without use of tools.

It is additionally proposed that the quick-change clamping device have at least one operating unit for moving the clamping element into the clamping position, and/or into a release position of the clamping element in which the insert-tool unit can be removed from the clamping unit, and at least one force transformation unit, which is coupled to the operating unit and which is designed to amplify a force from the operating unit acting upon the clamping element. Preferably, by means of a mechanical connection, the clamping element can be moved between at least the operating element, the operating unit and the clamping element, by means of the operating unit, into the clamping position and/or into the release position. Preferably, the operating element is realized as an operating lever, in particular as a swivel-mounted operating lever, as an operating button and/or as an operating pull lever. Also conceivable in principle, however, are other designs of the operating element that are considered appropriate by persons skilled in the art. It is also conceivable, however, that an electrical signal can be generated by means of an operating element of the operating unit, by means of which electrical signal an actuator, which is designed to move the clamping element into the clamping position and/or into the release position, can be controlled. The operating unit may be realized as a mechanical, electrical and/or electronic operating unit, which is designed to move the clamping element into the clamping position and/or into the release position as a result of an operating command of an operator and/or of an operating force of an operator. The force transformation unit is intended, in particular, to amplify a force acting from the operating unit upon the clamping element, by means of a transformation and/or in particular by means of an additional force-boosting element such as, for example, a pressure cylinder. Preferably, a movement of the operating element of the operating unit undergoes transformation when being transmitted to the clamping element. Preferably, a long movement of the operating element is transformed into a short, and thus stronger, movement of the clamping element. The force transformation unit in this case may be realized in various ways, considered appropriated by persons skilled in the art. An advantageously high degree of operating convenience can be achieved as a result. In particular, actuation of the clamping unit can be achieved even with a small expenditure of force.

Furthermore, it is proposed that the clamping element be formed by a toggle lever mounted so as to be rotatable about a rotation axis that is perpendicular to the rotation axis of the output shaft. Preferably, the clamping element has a positionally fixed rotation axis, the clamping element being mounted so as to be rotatable about same, at least within a limited angular range. Preferably, the clamping element is mounted so as to be rotatable within a defined angular range that is delimited by two end stops. The clamping element is designed, in particular, to tilt for the purpose of changing between the clamping position and the release position. Preferably, at at least one end of the toggle lever, the clamping element has a positive-engagement extension that is designed to engage directly behind the insert-tool unit. It would also be conceivable in this case, in particular, for the output shaft, likewise, additionally to have a fixed positive-engagement extension, in which the insert-tool unit must be inserted. This makes it possible, in particular, to provide an advantageous design of the clamping element. In particular, it is possible to provide a clamping element by means of which, advantageously, a moment of force can be applied.

It is additionally proposed that the clamping element have at least one first eccentric force introduction point, upon which a spring force acts, in at least one operating state, for the purpose of rotating the clamping element into a clamping position. Preferably, the first eccentric force introduction point is eccentric with respect to the rotation axis of the clamping element. Preferably, the first eccentric force introduction point is both eccentric with respect to the rotation axis of the clamping element and eccentric with respect to the rotation axis of the output shaft. In particular, the first eccentric force introduction point is eccentric with respect to the rotation axis of the clamping element, as viewed in the axial direction of the output shaft. Particularly preferably, force is also introduced eccentrically into the force introduction point. In particular, force is introduced parallel to the rotation axis of the output shaft. This means, in particular, that a force vector of a force acting upon the force introduction point intersects neither the rotation axis of the clamping element nor the rotation axis of the output shaft. Preferably, the clamping element is rotated by the eccentricity, in particular up to a stop that realizes the clamping position, when force is introduced at the first eccentric force introduction point.

It is additionally proposed that the quick-change clamping device have at least one operating unit for moving the clamping element into the clamping position, and/or into a release position of the clamping element in which the insert-tool unit can be removed from the clamping unit, wherein the operating unit, for the purpose of rotating the clamping element into a release position, is designed to act upon a second eccentric force introduction point that is spaced apart from the first eccentric force introduction point. Preferably, the second eccentric force introduction point is arranged on a side of the rotation axis of the clamping element that is opposite to the first eccentric force introduction point. Preferably, the second eccentric force introduction point, for the purpose of rotating the clamping element, is arranged in a direction opposite to that of the first eccentric force introduction point. In particular, the second eccentric force introduction point is eccentric with respect to the rotation axis of the clamping element. Preferably, the second eccentric force introduction point is both eccentric with respect to the rotation axis of the clamping element and eccentric with respect to the rotation axis of the output shaft. In particular, the second eccentric force introduction point is eccentric with respect to the rotation axis of the clamping element, as viewed in the axial direction of the output shaft. Particularly preferably, force is also introduced eccentrically into the force introduction point. In particular, force is introduced parallel to the rotation axis of the output shaft. Preferably, when force is introduced at the second eccentric force introduction point, the clamping element is rotated by the eccentricity, in particular up to a stop that realizes the release position.

It is further proposed that the clamping unit have at least one spring element designed to directly apply a force to the at least one clamping element, in at least one operating state, at least substantially perpendicularly in relation to the rotation axis of the output shaft. Preferably, the at least one spring element is designed to exert a spring force perpendicularly in relation to the rotation axis of the output shaft. A "spring element" is to be understood to mean, in particular, a macroscopic element having at least one extent that, in a normal operating state, can be varied elastically by at least 10%, in particular by at least 20%, preferably by at least 30%, and particularly advantageously by at least 50% and that, in particular, generates a counter-force, which is dependent on a variation of the extent and preferably proportional to the variation and which counteracts the variation. An "extent" of an element is to be understood to mean, in particular, a maximum distance of two points of a perpendicular projection of the element on to a plane. A "macroscopic element" is to be understood to mean, in particular, an element having an extent of at least 1 mm, in particular of at least 5 mm, and preferably of at least 10 mm. In particular, this makes it possible, advantageously, to achieve direct tilting of the clamping element by the spring element. In particular, advantageously, a spring force can thus be of a small magnitude.

It is further proposed that the clamping unit have at least one spring element designed to move the at least one clamping element into a clamping position, and at least one deflection element, which is designed to deflect a force of the spring element into a direction that is at least substantially perpendicular to the rotation axis of the output shaft. Preferably, the at least one spring element is designed to exert a spring force parallel to the rotation axis of the output shaft, the deflection element being designed to deflect the force of the spring element by 90°. A deflection by the deflection element may be realized, for example, by means of a wedge-shaped portion on the deflection element. Preferably, the deflection element is formed by a ring having a triangular cross section. Preferably, the spring element is designed to exert a spring force axially upon the deflection element, the deflection element, because of the resultant axial movement, displacing the clamping element radially and deflecting it at least substantially perpendicularly in relation to the rotation axis of the output shaft. An advantageous application of force upon the clamping element can thereby be achieved, in particular even in the case of radially restricted structural space. In particular, an advantageous deflection of force can be achieved. As a result, advantageously, engagement behind can be realized.

It is furthermore proposed that the clamping unit have at least one first spring element designed to move the at least one clamping element into a clamping position, and at least one second spring element, which is weaker than the first spring element and which is designed to move the at least one clamping element into a release position. Preferably, at least one effective spring force of the second spring element is substantially less than an effective spring force of the first spring element. Preferably, the second spring element is designed to move the clamping element into a release position in the absence of loading by the first spring element. This makes it possible, in particular, for the clamping element to move automatically into a release position as soon as an operator takes the loading by the first spring element, such as, for example, by pulling back the spring element. This makes it possible, in particular, to achieve an advantageous force efficiency, in particular, in the case of an axially aligned first spring element, a release of the quick-change clamping device, in particular since the clamping element must be deflected at least partially transversely in relation to the rotation axis for the purpose of release.

It is further proposed that the clamping element have at least one resilient sub-section that, in the case of the insert-tool unit being received with positive engagement, is designed to be deflected at least substantially perpendicularly in relation to the rotation axis of the output shaft. Preferably, the resilient sub-section is designed, in the case of the insert-tool unit being received with positive engagement, to be deflected, at least substantially perpendicularly in relation to the rotation axis of the output shaft, in a direction away from the rotation axis. Preferably, the resilient sub-section is designed, in the case of the insert-tool unit being released, to be deflected, at least substantially perpendicularly in relation to the rotation axis of the output shaft, in a direction toward the rotation axis. Preferably, the clamping element is realized, in particular, in the manner of a clamp having at least two elongated extensions. Preferably, the clamping element is realized at least partially in a U-shape, the two free ends each being connected to a base side via a resilient sub-section. This makes it possible, in particular, to provide advantageously safe securing of the insert-tool unit. In particular, at least a portion of a force required to secure the insert-tool unit can be applied by the clamping element itself. In this way, for example, a component quantity or a structural space can be kept advantageously small.

It is further proposed that the clamping unit have at least one ramp, which is designed to deflect at least a sub-region of the clamping element differently, in dependence on an axial position, perpendicularly in relation to the rotation axis of the output shaft. Preferably, the ramp is arranged, in particular, on a spindle cup of the output shaft and/or on the clamping element. The ramp is designed, in particular, to act directly between the clamping element and the output shaft. In particular, the ramp forms a contact surface between the clamping element and the output shaft. The ramp in this case is inclined, in particular, in relation to a rotation axis of the output shaft. Preferably, over a distance the ramp may change in inclination with respect to the rotation axis of the output shaft. This makes it possible, in particular, to achieve advantageously precise guiding of the clamping element. In particular, it is possible to achieve advantageously exact positioning of the clamping element in dependence on an axial position.

It is further proposed that the clamping element be formed by a toggle lever mounted so as to be rotatable about a rotation axis that is perpendicular to the rotation axis of the output shaft, wherein one end of the clamping element is guided in a coulisse that is mounted so as to be movable relative to the rotation axis of the clamping element. Preferably, the coulisse is guided so as to be movable axially relative to the rotation axis of the clamping element. Preferably, the coulisse is moved axially relative to the rotation axis of the clamping element, for the purpose of adjusting the quick-change clamping device, in particular from a clamping position into a release position and/or vice versa. Particularly preferably, in the case of the coulisse being moved axially relative to the rotation axis of the clamping element, the clamping element is swiveled about the rotation axis. Preferably, one end of the clamping element may be guided both directly and indirectly in the coulisse, such as, for example, via a lever guided on and/or in the coulisse, and/or via a roller guided on and/or in the coulisse.

Furthermore, the disclosure is based on a power tool, in particular a power angle grinder, having an output shaft that can be driven in rotation, and having a quick-change clamping device.

The disclosure is additionally based on a power tool system comprising the power tool, having the quick-change clamping device, and comprising an insert-tool unit that can be received in the quick-change clamping device.

The quick-change clamping device according to the disclosure, the power tool and the power tool system are not intended in this case to be limited to the application and embodiment described above. In particular, the quick-change clamping device according to the disclosure, the power tool and the power tool system may have individual elements, components and units that differ in number from a number stated herein, in order to fulfill a functionality described herein.

BRIEF DESCRIPTION OF THE DRAWINGS

Further advantages are given by the following description of the drawings. The drawings show fifteen exemplary embodiments of the disclosure. The drawings, the description, and the claims contain numerous features in combination. Persons skilled in the art will also expediently consider the features individually and combine them to create appropriate further combinations.

There are shown.

DETAILED DESCRIPTION

Figure 1:
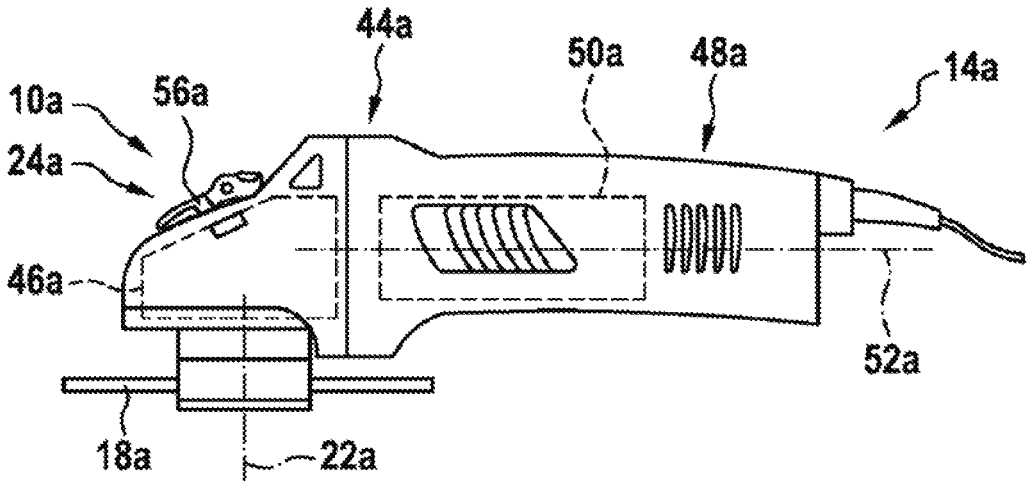
FIG. 1 a portable power tool according to the disclosure, having a quick-change clamping device according to the disclosure, in a schematic representation, FIG. 2 a detail of the portable power tool according to the disclosure and of the quick-change clamping device according to the disclosure, in a schematic sectional representation, in a clamping position, FIG. 3 a detail of an alternative portable power tool according to the disclosure and of an alternative quick-change clamping device according to the disclosure, in a schematic sectional representation, in a clamping position, FIG. 4 a detail of a further alternative portable power tool according to the disclosure and of an alternative quick-change clamping device according to the disclosure, in a schematic sectional representation, in a clamping position, FIG. 5 a detail of a further alternative portable power tool according to the disclosure and of an alternative quick-change clamping device according to the disclosure, in a schematic sectional representation, in a clamping position, FIG. 6 a detail of a further alternative portable power tool according to the disclosure and of an alternative quick-change clamping device according to the disclosure, in a schematic sectional representation, in a clamping position, FIG. 7 a detail of a further alternative portable power tool according to the disclosure and of an alternative quick-change clamping device according to the disclosure, in a schematic sectional representation, in a clamping position, FIG. 8 a detail of a further alternative portable power tool according to the disclosure and of an alternative quick-change clamping device according to the disclosure, in a schematic sectional representation, in a clamping position, FIG. 9 a detail of a further alternative portable power tool according to the disclosure and of an alternative quick-change clamping device according to the disclosure, in a schematic sectional representation, in a clamping position, FIG. 10 a detail of a further alternative portable power tool according to the disclosure and of an alternative quick-change clamping device according to the disclosure, in a schematic sectional representation, in a clamping position, FIG. 11 a detail of a further alternative portable power tool according to the disclosure and of an alternative quick-change clamping device according to the disclosure, in a schematic sectional representation, in a clamping position, FIG. 12 a detail of a further alternative portable power tool according to the disclosure and of an alternative quick-change clamping device according to the disclosure, in a schematic sectional representation, in a clamping position, FIG. 13 a detail of a further alternative portable power tool according to the disclosure and of an alternative quick-change clamping device according to the disclosure, in a schematic sectional representation, FIG. 14 a detail of a further alternative portable power tool according to the disclosure and of an alternative quick-change clamping device according to the disclosure, in a schematic sectional representation, in a release position, FIG. 15 a detail of a further alternative portable power tool according to the disclosure and of an alternative quick-change clamping device according to the disclosure, in a schematic sectional representation, in a clamping position, and FIG. 16 a detail of a further alternative portable power tool according to the disclosure and of an alternative quick-change clamping device according to the disclosure, in a schematic sectional representation, in a clamping position.

FIG. 1 shows a portable power tool 14*a*, realized as a power angle grinder, having a quick-change clamping device 10*a*. It is also conceivable, however, for the portable power tool 14*a* to be of a different design, considered appropriate by persons skilled in the art, such as, for example, designed as a power circular saw, as a power sander, or the like. The portable power tool 14*a* comprises a transmission housing 44*a* for accommodating or mounting a transmission unit 46*a* of the portable power tool 14*a*. The transmission housing 44*a* is preferably made of a metallic material. It is also conceivable, however, for the transmission housing 44*a* to be made of a different material, considered appropriate by persons skilled in the art, such as, for example, of plastic, or the like. The transmission unit 46*a* is preferably realized as a bevel gear transmission. The transmission unit 46*a* comprises, in particular, an output shaft 12*a*, which can be driven in rotation and to which an insert-tool unit 18*a* can be fixed, in particular by means of the quick-change clamping device 10*a*. The power tool 14*a* comprises the output shaft 12*a* that can be driven in rotation. The output shaft 12*a* is preferably realized as a hollow spindle, in which the quick-change clamping device 10*a* is arranged, at least partially (see FIG. 2). A protective hood unit, not represented in greater detail here, can be arranged on the transmission housing 44*a*, in a manner already known to persons skilled in the art. An ancillary handle, not represented in greater detail here, can be arranged on the transmission housing 44*a*, in a manner already known to persons skilled in the art. The portable power tool 14*a* comprises a motor housing 48*a*, for accommodating and/or mounting a drive unit 50*a* of the portable power tool 14*a*. The drive unit 50*a* is preferably designed, in a manner already known to persons skilled in the art, to drive the output shaft 12*a* in rotation about a rotation axis 22*a* of the output shaft 12*a*, by means of a combined action with the transmission unit 46*a*. The rotation axis 22*a* of the output shaft 12*a* is at least substantially perpendicular to a drive axis 52*a* of the drive unit 50*a*. The drive unit 50*a* is preferably realized as an electric-motor unit. It is also conceivable, however, for the drive unit 50*a* to be of a different design, considered appropriate by persons skilled in the art, such as, for example, designed as an internal-combustion drive unit, as a hybrid drive unit, as a pneumatic drive unit, or the like. The power tool 14*a*, the quick-change clamping device 10*a*, and the insert-tool unit 18*a* that can be received in the quick-change clamping device 10*a* form a power tool system.

Figure 2:
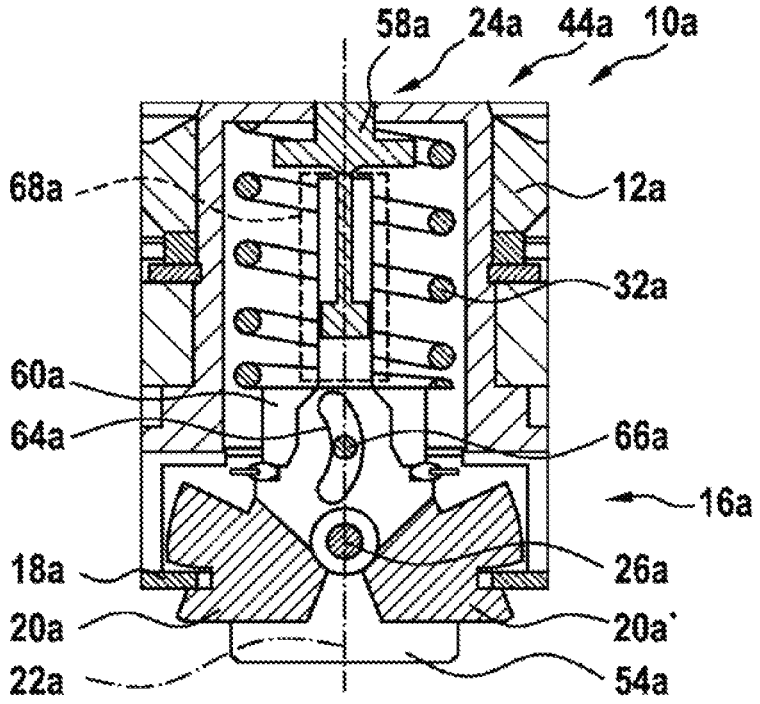

FIG. 2 shows a sectional view of the portable power tool 14*a*, in particular in the region of the transmission housing 44*a*, and of the quick-change clamping device 10*a*. The quick-change clamping device 10*a* for the portable power tool 14*a*, which comprises the output shaft 12*a* that can be driven in rotation, comprises at least one clamping unit 16*a* which, for the purpose of fixing the insert-tool unit 18*a* to the output shaft 12*a* without the use of tools, has at least one movably mounted clamping element 20*a*, 20*a*', for applying a clamping force to the insert-tool unit 18*a* when the clamping element 20*a*, 20*a*' is in a clamping position. The quick-change clamping device 10*a* additionally comprises at least one operating unit 24*a*, for moving the at least one clamping element 20*a*, 20*a*' into a clamping position, and/or into a release position of the clamping element 20*a*, 20*a*' in which the insert-tool unit 18*a* can be removed from the clamping unit 16*a* and/or from the output shaft 12*a*. The clamping unit 16*a* comprises at least two movably mounted clamping elements 20*a*, 20*a*'. It is also conceivable, however, for the clamping unit 16*a* to comprise a number of clamping elements 20*a*, 20*a*' other than two. The two clamping elements 20*a*, 20*a*' are of a substantially similar design, such that features disclosed in connection with one of the clamping elements 20*a*, 20*a*' are to be considered as also having been disclosed for the further clamping element 20*a*, 20*a*'. The two clamping elements 20*a*, 20*a*' are swivel-mounted. A rotation axis 26*a* of the two clamping elements 20*a*, 20*a*' is at least substantially perpendicular to the rotation axis 22*a* of the output shaft 12*a*. The rotation axis 26*a* of the clamping elements 20*a*, 20*a*' is formed by a swivel axis. The two clamping elements 20*a*, 20*a*' are designed, in particular when the two clamping elements 20*a*, 20*a* are in the clamping position, to fix the insert-tool unit 18*a*, when having been arranged on the clamping unit 16*a* and/or on the output shaft 12*a*, axially on the output shaft 12*a*. The two clamping elements 20*a*, 20*a*' are connected to the output shaft 12*a* in a rotationally fixed manner. The rotation axis 26*a* of the clamping elements 20*a*, 20*a*' is fixedly connected to the output shaft 12*a*. The two clamping elements 20*a*, 20*a*' can be driven in rotation, together with the output shaft 12*a*, about the rotation axis 22*a*.

The clamping elements 20*a*, 20*a*' are each formed by a positive-engagement element that is movable transversely in relation to the rotation axis 22*a* of the output shaft 12*a*. In addition, the clamping elements 20*a*, 20*a*' are designed to engage with positive engagement behind at least a sub-region of the insert-tool unit 18*a* for the purpose of securing the insert-tool unit 18*a*. For the purpose of securing the insert-tool unit 18*a*, the clamping unit 16*a* is designed to engage with positive engagement behind the insert-tool unit 18*a* by a movement, directed at least partially radially in relation to a rotation axis 22*a* of the output shaft 12*a*, of at least a sub-section of each of the clamping elements 20*a*, 20*a*'. In this case, for the purpose of directly applying clamping force to the insert-tool unit 18*a*, the movably mounted clamping elements 20*a*, 20*a*' are arranged in a clamping position of the clamping element 20*a*, 20*a*'. The clamping force is applied, in particular automatically, by the quick-change clamping device 10*a*, such as, for example, by a spring element 32*a*.

The clamping unit 16*a* comprises at least one torque driving element 54*a* for the purpose of transmitting torque to the insert-tool unit 18*a*. When the insert-tool unit 18*a* has been arranged on the clamping unit 16*a* and/or on the output shaft 12*a*, the torque driving element 54*a* engages in a receiving recess (not represented in greater detail here) of the insert-tool unit 18*a* and, for the purpose of transmitting torque, bears against at least one edge of the insert-tool unit 18*a* that delimits the receiving recess. Transmission of torque between the output shaft 12*a* and the insert-tool unit 18*a* arranged on the clamping unit 16*a* and/or on the output shaft 12*a* is preferably effected, in a manner already known to persons skilled in the art, by means of a positive-engagement connection between the torque driving element 54*a* and the insert-tool unit 18*a*. The torque driving element 54*a* is arranged in a rotationally fixed manner on the output shaft 12*a*. The torque driving element 54*a* can be driven in rotation, together with the output shaft 12*a*, about the rotation axis 22*a*. Preferably, the clamping unit 16*a* comprises a plurality of torque driving elements 54*a* for the purpose of transmitting torque to the insert-tool unit 18*a*.

The operating unit 24*a* is preferably designed to move the two clamping elements 20*a*, 20*a*' at least into the release position, in which the insert-tool unit 18*a* can be removed from the clamping unit 16*a* and/or from the output shaft 12*a*. Alternatively or additionally, it is conceivable for the operating unit 24*a* to be designed to move the two clamping elements 20*a*, 20*a*' at least into the clamping position, in which the insert-tool unit 18*a* can be fixed to the output shaft 12*a* by means of the clamping unit 16*a*. The operating unit 24*a* comprises an operating element 56*a*, which can be actuated by an operator. The operating element 56*a* is realized as an operating lever. In principle, however, a different design of the operating element 56*a*, considered appropriated by persons skilled in the art, such as, for example, as a pushbutton and/or as a pull lever, would also be conceivable. The operating element 56*a* comprises a movement axis, not shown further, in particular a swivel axis, which runs transversely, in particular at least substantially perpendicularly, in relation to the rotation axis 22*a* of the output shaft 12*a*. The operating element 56*a* is preferably mounted so as to be swivelable about the movement axis, in particular the swivel axis. The operating element 56*a* is decoupled from a rotary motion of the output shaft 12*a*. The operating element 56*a* comprises an eccentric portion for actuation of an actuating element 58*a* of the operating unit 24*a*. The actuating element 58*a* is mounted so as to be translationally movable along the rotation axis 22*a*, in particular in the output shaft 12*a* and/or in the transmission housing 44*a*. The actuating element 58*a* is fixed, in the transmission housing unit 44*a*, against rotation relative to the transmission housing unit 44*a*, in particular due at least to a lateral flattening of the actuating element 58*a* that allows an axial movement and prevents a rotary movement. Preferably the actuating element 58*a* has at least one flattening on each of the two sides of the actuating element 58*a* that face away from each other. It is also conceivable, however, for the actuating element 58*a* to be of another design, considered appropriate by persons skilled in the art, such as, for example, as a polygonal cross section, a toothing, or the like, that is designed to secure the actuating element 58*a* against rotation relative to the transmission housing 44*a*. Arranged in the region of the actuating element 58*a* there is preferably a sealing element such as, for example, a rubber seal or the like, in order, in particular, at least largely to avoid ingress of dirt into the transmission housing 44*a* and/or the clamping unit 16*a*. The sealing element preferably bears against the actuating element 58*a*. The actuating element 58*a* is mounted so as to be movable, in particular relative to the sealing element. When moving relative to the sealing element, the actuating element 58*a* slides along at least one sealing surface of the sealing element.

As far as possible, movement of the actuating element 58*a* as a result of an action of an operator force by means of the operating unit 24*a*, to move the clamping elements 20*a*, 20*a*', starting from the clamping position, into the release position during a rotary motion of the output shaft 12*a*, is prevented. An axial force, acting from the actuating element 58*a* upon the clamping elements 20*a*, 20*a*', can be transmitted when the output shaft 12*a* is rotating at a low rotational speed, or when the output shaft 12*a* is at a standstill. For this purpose, there is a transmission element 60*a* arranged between the actuating element 58*a* and the clamping elements 20*a*, 20*a*'. The transmission element 60*a* is guided axially in a delimited region within the output shaft 12*a*. The transmission element 60*a* is coupled to the actuating element 58*a*. In addition, the actuating element 58*a* is pressed, by means of a spring element 32*a*, into an upper position assigned to the clamping position. By means of the operating unit 24*a*, in particular as a result of a displacement of the actuating element 58*a*, the transmission element 60*a* can be moved contrary to a spring force of the spring element 32*a*. The transmission element 60*a* is designed to move the clamping element 20*a*, 20*a*', starting from the clamping position, into the release position. The operating unit 24*a* is coupled to the clamping unit 16*a*. The clamping elements 20*a*, 20*a*' can be moved into the release position by means of the operating unit 24*a*.

The clamping elements 20*a*, 20*a*' are movably mounted in the output shaft 12*a*, in particular swivel-mounted. The clamping elements 20*a*, 20*a*' have at least one movement coulisse element 64*a*, which is designed to act in combination with a coulisse engagement element 66*a* of the clamping unit 16*a*. The coulisse engagement element 66*a* is fixed to the transmission element 60*a*. The coulisse engagement element 66*a* is realized as a bolt, which is fixed to the transmission element 60*a*, in particular between two fork ends of the transmission element 60*a*. As a result of a combined action of the coulisse engagement element 66*a* and the movement coulisse element 64*a*, the clamping elements 20*a*, 20*a*' can be moved, starting from the clamping position, into the release position, or from the release position into the clamping position. The clamping elements 20*a*, 20*a*' can be moved, starting from the release position, into the clamping position, in particular by means of an action of a spring force of the spring element 32*a* upon the transmission element 60*a*. The clamping elements 20*a*, 20*a*' can be moved automatically into the clamping position, in particular following removal of an action of an operator force via the operating unit 24*a*, due to an action of a spring force of the spring element 32*a*.

The quick-change clamping device 10*a* has a force transformation unit 68*a*, which is coupled to the operating unit 24*a* and which is designed to amplify a force acting from the operating unit 24*a* upon the clamping elements 20*a*, 20*a*'. The force transformation unit 68*a* is designed to amplify a force acting from the operating unit 24*a* upon the clamping elements 20*a*, 20*a*', by means of an additional force-boosting element, not shown further, such as, for example, a pressure cylinder. The boosting element, not shown further, of the force transformation unit 68*a* is connected between the actuating element 58*a* and the transmission element 60*a*. In principle, however, a different design of the force-boosting element of the force transformation unit 68*a*, considered appropriated by persons skilled in the art, would also be conceivable.

Fourteen further exemplary embodiments of the disclosure are shown in FIGS. 3 to 16. The following descriptions and the drawings are limited substantially to the differences between the exemplary embodiments and, in principle, reference may be made to the drawings and/or the description of the other exemplary embodiments, in particular to FIGS. 1 and 2, in respect of components having the same designation, in particular in respect of components having the same reference numerals. To distinguish the exemplary embodiments, the letter a has been appended to the references of the exemplary embodiment in FIGS. 1 and 2. In the exemplary embodiments of FIGS. 3 to 16, the letter a has been replaced by the letters b to o.

Figure 3:
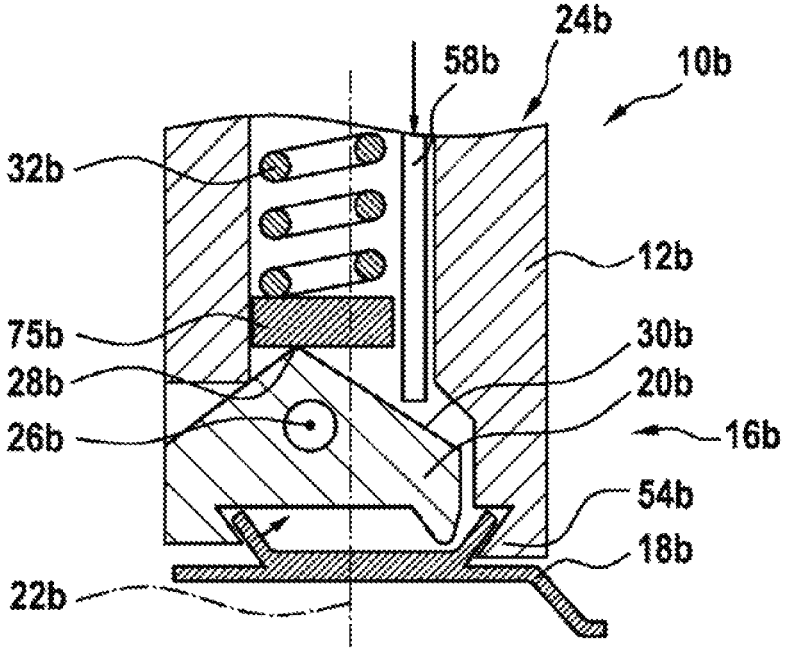

FIG. 3 shows a sectional view of the portable power tool 14*b*, in particular in the region of the transmission housing, and of the quick-change clamping device 10*b*. The quick-change clamping device 10*b*, for a portable power tool 14*b* having an output shaft 12*b* that can be driven in rotation, comprises at least one clamping unit 16*b* which, for the purpose of fixing the insert-tool unit 18*b* to the output shaft 12*b* without the use of tools, has at least one movably mounted clamping element 20*b*, for applying a clamping force to the insert-tool unit 18*b* when the clamping element 20*b* is in a clamping position. The quick-change clamping device 10*b* additionally comprises at least one operating unit 24*b*, for moving the at least one clamping element 20*b* into a clamping position, and/or into a release position of the clamping element 20*b* in which the insert-tool unit 18*b* can be removed from the clamping unit 16*b* and/or from the output shaft 12*b*.

The clamping element 20*b* is swivel-mounted. A rotation axis 26*b* of the clamping element 20*b* is at least substantially perpendicular to the rotation axis 22*b* of the output shaft 12*b*. The clamping element 20*b* is formed by a toggle lever mounted so as to be rotatable about a rotation axis 26*b* that is perpendicular to the rotation axis 22*b* of the output shaft 12*b*. The clamping element 20*b* is designed, in particular when the clamping element 20*b* is in the clamping position, to fix the insert-tool unit 18*b*, when having been arranged on the clamping unit 16*b* and/or on the output shaft 12*b*, axially on the output shaft 12*b*. The clamping element 20*b* is connected to the output shaft 12*b*. The rotation axis 26*b* of the clamping element 20*b* is fixedly connected to the output shaft 12*b*. The clamping element 20*b* can be driven in rotation, together with the output shaft 12*b*, about the rotation axis 22*b*.

The clamping element 20*b* is formed by a positive-engagement element that is movable transversely in relation to the rotation axis 22*b* of the output shaft 12*b*. In addition, the clamping element 20*b* is designed to engage with positive engagement behind at least a sub-region of the insert-tool unit 18*b* for the purpose of securing the insert-tool unit 18*b*. For this purpose, the clamping element 20*b* has a hook-shaped extension that, when the clamping element 20*b* is in a clamping position, engages with positive engagement behind a sub-region of the insert-tool unit 18*b*. For the purpose of securing the insert-tool unit 18*b*, the clamping unit 16*b* is designed to engage with positive engagement behind the insert-tool unit 18*b* by a movement, directed at least partially radially in relation to a rotation axis 22*b* of the output shaft 12*b*, of at least a sub-section of the clamping element 20*b*. In this case, for the purpose of directly applying clamping force to the insert-tool unit 18*b*, the movably mounted clamping elements 20*b* is arranged in a clamping position of the clamping element 20*b*. The clamping force is applied, in particular automatically, by the quick-change clamping device 10*b*, such as, for example, by a spring element 32*b*.

The operating unit 24*b* is preferably designed to move the clamping element 20*b* at least into the release position, in which the insert-tool unit 18*b* can be removed from the clamping unit 16*b* and/or from the output shaft 12*b*. The operating unit 24*b* comprises an operating element, which can be actuated by an operator. The operating element is realized as an operating lever. In principle, however, a different design of the operating element, considered appropriated by persons skilled in the art, such as, for example, as a pushbutton and/or as a pull lever, would also be conceivable. The operating element comprises an eccentric portion for actuation of an actuating element 58*b* of the operating unit 24*b*. The actuating element 58*b* is mounted so as to be translationally movable along the rotation axis 22*b*, in particular in the output shaft 12*b* and/or in the transmission housing. The actuating element 58*b* is fixed, in the transmission housing, against rotation relative to the transmission housing, in particular due at least to a lateral flattening of the actuating element 58*b* that allows an axial movement and prevents a rotary movement.

The clamping element 20*b* additionally has a first eccentric force introduction point 28*b*. The first eccentric force introduction point 28*b* is eccentric with respect to the rotation axis 26*b* of the clamping element 20*b*. The first eccentric force introduction point 28*b* is both eccentric with respect to the rotation axis 26*b* of the clamping element 20*b* and eccentric with respect to the rotation axis 22*b* of the output shaft 12*b*. The first eccentric force introduction point 28*b* is eccentric with respect to the rotation axis 26*b* of the clamping element 20*b*, as viewed in the axial direction of the output shaft 12*b*. In addition, force is also introduced eccentrically into the force introduction point 28*b*. Force is introduced parallel to the rotation axis 22*b* of the output shaft 12*b*. For the purpose of rotating the clamping element 20*b* into a clamping position, a spring force acts upon the first eccentric force introduction point 28*b*, in at least one operating state. Introduction of force to the clamping element 20*b* is effected, in the first force introduction point 28*b*, by a spring element 32*b*. The spring element 32*b* is formed by a coil spring. In principle, however, a different design of the spring element 32*b*, considered appropriated by persons skilled in the art, would also be conceivable. The spring element 32*b* is designed to exert a spring force upon the clamping element 20*b*, which moves the clamping element 20*b* into a clamping position and/or holds it in a clamping position. When force is introduced by the spring element 32*b* at the first eccentric force introduction point 28*b*, the clamping element 20*b* is rotated by the eccentricity, up to a stop that realizes the clamping position. For precise application of force, there is an axially displaceable intermediate plate 75*b* arranged between the clamping element 20*b* and the spring element 32*b*. By means of the operating unit 24*b*, the clamping element 20*b* can be moved, contrary to the spring force of the spring element 32*b*, into the release position, in which the clamping element 20*b* does not engage behind the insert-tool unit 18*b*. The operating unit 24*b* is designed, when the clamping element 20*b* is being rotated into the release position, to act upon a second eccentric force introduction point 30*b*, which is spaced apart from the first eccentric force introduction point 28*b*.

Figure 4:
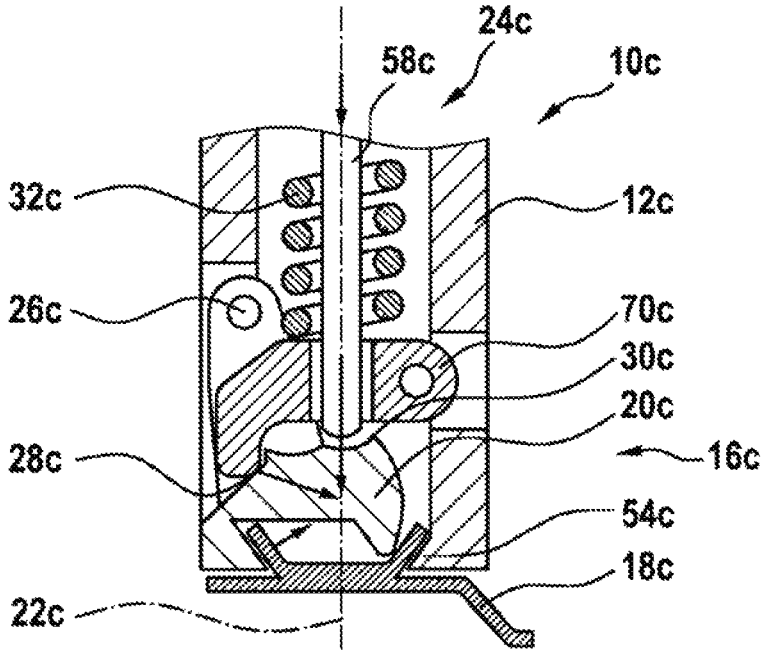

The second eccentric force introduction point 30*b* is arranged on a side of the rotation axis 26*b* of the clamping element 20*b* that is opposite to the first eccentric force introduction point 28*b*. In addition, the second eccentric force introduction point 30*b*, for the purpose of rotating the clamping element 20*b*, is provided in a direction opposite to that of the first eccentric force introduction point 28*b*. The second eccentric force introduction point 30*b* is eccentric with respect to the rotation axis 26*b* of the clamping element 20*b* and with respect to the rotation axis 22*b* of the output shaft 12*b*. In particular, the second eccentric force introduction point 30*b* is eccentric with respect to the rotation axis 26*b* of the clamping element 20*b*, as viewed in the axial direction of the output shaft 12*b*. Force is also introduced eccentrically into the second force introduction point 30*b*. Force is introduced parallel to the rotation axis 22*b* of the output shaft 12*b*. Force is introduced directly by the actuating element 58*b* of the operating unit 24*b*. When force is introduced by the actuating element 58*b* the operating element 56*b* at the second eccentric force introduction point 30*b*, the clamping element 20*b* is rotated by the eccentricity, up to a stop that realizes the release position, in which the insert-tool unit 18*b* can be attached or removed. FIG. 4 shows a sectional view of the portable power tool 14*c*, in particular in the region of the transmission housing, and of the quick-change clamping device 10*c*. The quick-change clamping device 10*c*, for a portable power tool 14*c* having an output shaft 12*c* that can be driven in rotation, comprises at least one clamping unit 16*c* which, for the purpose of fixing the insert-tool unit 18*c* to the output shaft 12*c* without the use of tools, has at least one movably mounted clamping element 20*c*, for applying a clamping force to the insert-tool unit 18*c* when the clamping element 20*c* is in a clamping position. The quick-change clamping device 10*c* additionally comprises at least one operating unit 24*c*, for moving the at least one clamping element 20*c* into a clamping position, and/or into a release position of the clamping element 20*c* in which the insert-tool unit 18*c* can be removed from the clamping unit 16*c* and/or from the output shaft 12*c*.

The clamping element 20*c* is swivel-mounted. A rotation axis 26*c* of the clamping element 20*c* is at least substantially perpendicular to the rotation axis 22*c* of the output shaft 12*c*. The clamping element 20*c* is formed by a toggle lever mounted so as to be rotatable about a rotation axis 26*c* that is perpendicular to the rotation axis 22*c* of the output shaft 12*c*. The clamping element 20*c* is designed, in particular when the clamping element 20*c* is in the clamping position, to fix the insert-tool unit 18*c*, when having been arranged on the clamping unit 16*c* and/or on the output shaft 12*c*, axially on the output shaft 12*c*. The rotation axis 22*c* is arranged on a circumference of the output shaft 12*c*. The clamping elements 20*c* is formed by a positive-engagement element that is movable transversely in relation to the rotation axis 22*c* of the output shaft 12*c*. In addition, the clamping element 20*c* is designed to engage with positive engagement behind at least a sub-region of the insert-tool unit 18*c* for the purpose of securing the insert-tool unit 18*c*. For this purpose, the clamping element 20*c* has a hook-shaped extension that, when the clamping element 20*c* is in a clamping position, engages with positive engagement behind a sub-region of the insert-tool unit 18*c*.

The operating unit 24*c* is designed to move the clamping element 20*c* at least into the release position, in which the insert-tool unit 18*c* can be removed from the clamping unit 16*c* and/or from the output shaft 12*c*. The operating unit 24*c* comprises an operating element, which can be actuated by an operator. The operating element comprises an eccentric portion for actuation of an actuating element 58*c* of the operating unit 24*c*. The actuating element 58*c* is mounted so as to be translationally movable along the rotation axis 22*c*, in particular in the output shaft 12*c* and/or in the transmission housing.

The clamping element 20*c* additionally has a first eccentric force introduction point 28*c*. The first eccentric force introduction point 28*c* is eccentric with respect to the rotation axis 26*c* of the clamping element 20*c*. The first eccentric force introduction point 28*c* is both eccentric with respect to the rotation axis 26*c* of the clamping element 20*c* and eccentric with respect to the rotation axis 22*c* of the output shaft 12*c*. The first eccentric force introduction point 28*c* is eccentric with respect to the rotation axis 26*c* of the clamping element 20*c*, as viewed in the axial direction of the output shaft 12*c*. In addition, force is also introduced eccentrically into the force introduction point 28*c*. Force is introduced in part transversely in relation to the rotation axis 22*c* of the output shaft 12*c*. For the purpose of rotating the clamping element 20*c* into a clamping position, a spring force acts upon the first eccentric force introduction point 28*c*, in at least one operating state. Introduction of force to the clamping element 20*c* is effected, in the first force introduction point 28*c*, by a spring element 32*c*. The spring element 32*c* is formed by a coil spring. The spring element 32*c* is designed to exert a spring force upon the clamping element 20*c*, which moves the clamping element 20*c* into a clamping position and/or holds it in a clamping position. When force is introduced by the spring element 32*c* at the first eccentric force introduction point 28*c*, the clamping element 20*c* is rotated by the eccentricity, up to a stop that realizes the clamping position. For the purpose of transmitting force from the spring element 32*c* to the clamping element 20*c*, a further toggle lever 70*c*, which is designed to exert the axially acting spring force of the spring element 32*c* upon the clamping element 20*c* by rotation, is arranged between the clamping element 20*c* and the spring element 32*c*. The toggle lever 70*c* has a rotation axis that is fixedly connected to the output shaft 12*c*. The rotation axis of the toggle lever 70*c* is arranged on a side of the output shaft 12*c* that is opposite to the rotation axis 26*c* of the clamping element 20*c*.

By means of the operating unit 24*c*, the clamping element 20*c* can be moved, contrary to the spring force of the spring element 32*c*, into the release position, in which the clamping element 20*c* does not engage behind the insert-tool unit 18*c*. The operating unit 24*c* is designed, when the clamping element 20*c* is being rotated into the release position, to act upon a second eccentric force introduction point 30*c*, which is spaced apart from the first eccentric force introduction point 28*c*. In addition, the second eccentric force introduction point 30*c*, for the purpose of rotating the clamping element 20*c*, is provided in a direction opposite to that of the first eccentric force introduction point 28*c*. The second eccentric force introduction point 30*c* is eccentric with respect to the rotation axis 26*c* of the clamping element 20*c* and with respect to the rotation axis 22*c* of the output shaft 12*c*. In particular, the second eccentric force introduction point 30*c* is eccentric with respect to the rotation axis 26*c* of the clamping element 20*c*, as viewed in the axial direction of the output shaft 12*c*. Force is also introduced eccentrically into the second force introduction point 30*c*. Force is introduced parallel to the rotation axis 22*c* of the output shaft 12*c*. Force is introduced directly by the actuating element 58*c* of the operating unit 24*c*. When force is introduced by the actuating element 58*c* the operating element 56*c* at the second eccentric force introduction point 30*c*, the clamping element 20*c* is rotated by the eccentricity, up to a stop that realizes the release position, in which the insert-tool unit 18*c* can be attached or removed. For this purpose, the actuating element 58*d* is routed through the toggle lever 70*d*.

Figure 5:
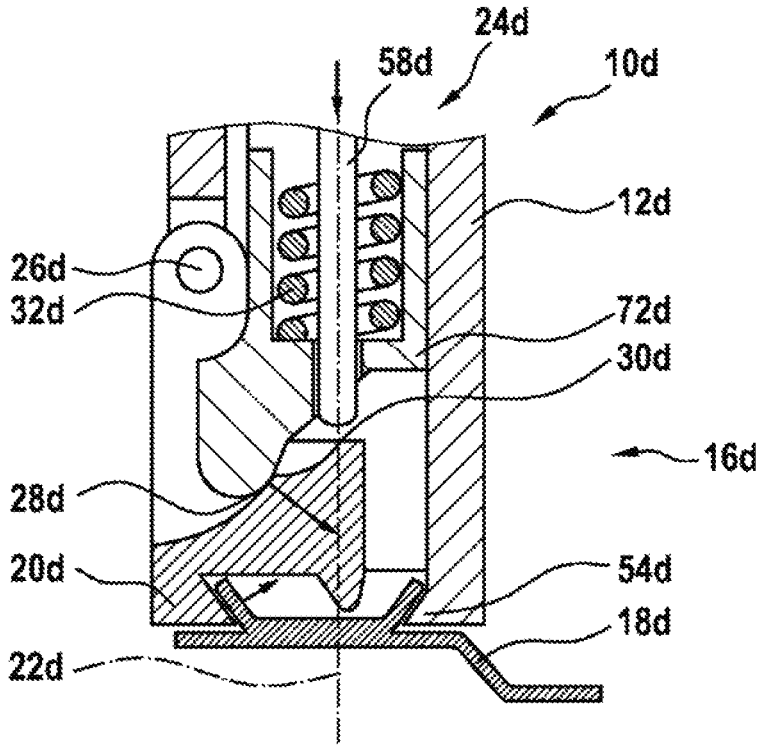

FIG. 5 shows a sectional view of the portable power tool 14*d*, in particular in the region of the transmission housing, and of the quick-change clamping device 10*d*. The quick-change clamping device 10*d*, for a portable power tool 14*d* having an output shaft 12*d* that can be driven in rotation, comprises at least one clamping unit 16*d* which, for the purpose of fixing the insert-tool unit 18*d* to the output shaft 12*d* without the use of tools, has at least one movably mounted clamping element 20*d*, for applying a clamping force to the insert-tool unit 18*d* when the clamping element 20*d* is in a clamping position. The quick-change clamping device 10*d* additionally comprises at least one operating unit 24*d*, for moving the at least one clamping element 20*d* into a clamping position, and/or into a release position of the clamping element 20*d* in which the insert-tool unit 18*d* can be removed from the clamping unit 16*d* and/or from the output shaft 12*d*.

The clamping element 20*d* is swivel-mounted. A rotation axis 26*d* of the clamping element 20*d* is at least substantially perpendicular to the rotation axis 22*d* of the output shaft 12*d*. The clamping element 20*d* is formed by a toggle lever mounted so as to be rotatable about a rotation axis 26*d* that is perpendicular to the rotation axis 22*d* of the output shaft 12*d*. The clamping element 20*d* is designed, in particular when the clamping element 20*d* is in the clamping position, to fix the insert-tool unit 18*d*, when having been arranged on the clamping unit 16*d* and/or on the output shaft 12*d*, axially on the output shaft 12*d*. The rotation axis 22*d* is arranged on a circumference of the output shaft 12*d*. The clamping elements 20*d* is formed by a positive-engagement element that is movable transversely in relation to the rotation axis 22*d* of the output shaft 12*d*. In addition, the clamping element 20*d* is designed to engage with positive engagement behind at least a sub-region of the insert-tool unit 18*d* for the purpose of securing the insert-tool unit 18*d*. For this purpose, the clamping element 20*d* has a hook-shaped extension that, when the clamping element 20*d* is in a clamping position, engages with positive engagement behind a sub-region of the insert-tool unit 18*d*.

The operating unit 24*d* is designed to move the clamping element 20*d* at least into the release position, in which the insert-tool unit 18*d* can be removed from the clamping unit 16*d* and/or from the output shaft 12*d*. The operating unit 24*d* comprises an operating element, which can be actuated by an operator. The operating element comprises an eccentric portion for actuation of an actuating element 58*d* of the operating unit 24*d*. The actuating element 58*d* is mounted so as to be translationally movable along the rotation axis 22*d*, in particular in the output shaft 12*d* and/or in the transmission housing.

The clamping element 20*d* additionally has a first eccentric force introduction point 28*d*. The first eccentric force introduction point 28*d* is eccentric with respect to the rotation axis 26*d* of the clamping element 20*d*. The first eccentric force introduction point 28*d* is both eccentric with respect to the rotation axis 26*d* of the clamping element 20*d* and eccentric with respect to the rotation axis 22*d* of the output shaft 12*d*. The first eccentric force introduction point 28*d* is eccentric with respect to the rotation axis 26*d* of the clamping element 20*d*, as viewed in the axial direction of the output shaft 12*d*. In addition, force is also introduced eccentrically into the force introduction point 28*d*. Force is introduced in part transversely in relation to the rotation axis

22*d* of the output shaft 12*d*. For the purpose of rotating the clamping element 20*d* into a clamping position, a spring force acts upon the first eccentric force introduction point 28*d*, in at least one operating state. Introduction of force to the clamping element 20*d* is effected, in the first force introduction point 28*d*, by a spring element 32*d*. The spring element 32*d* is formed by a coil spring. The spring element 32*d* is designed to exert a spring force upon the clamping element 20*d*, which moves the clamping element 20*d* into a clamping position and/or holds it in a clamping position. When force is introduced by the spring element 32*d* at the first eccentric force introduction point 28*d*, the clamping element 20*d* is rotated by the eccentricity, up to a stop that realizes the clamping position. For the purpose of transmitting force from the spring element 32*d* to the clamping element 20*d*, a guide cup 72*d*, which is designed to transmit the axially acting spring force of the spring element 32*d* eccentrically to the clamping element 20*d*, is arranged between the clamping element 20*d* and the spring element 32*d*. The guide cup 72*d* receives the spring element 32*d* in a cup shape and is guided axially in the output shaft 12*d*. The guide cup 72*d* additionally has an extension, which is designed to apply force to the first eccentric force introduction point 28*d* of the clamping element 20*d*.

By means of the operating unit 24*d*, the clamping element 20*d* can be moved, contrary to the spring force of the spring element 32*d*, into the release position, in which the clamping element 20*d* does not engage behind the insert-tool unit 18*d*. The operating unit 24*d* is designed, when the clamping element 20*d* is being rotated into the release position, to act upon a second eccentric force introduction point 30*d*, which is spaced apart from the first eccentric force introduction point 28*d*. In addition, the second eccentric force introduction point 30*d*, for the purpose of rotating the clamping element 20*d*, is provided in a direction opposite to that of the first eccentric force introduction point 28*d*. The second eccentric force introduction point 30*d* is eccentric with respect to the rotation axis 26*d* of the clamping element 20*d* and with respect to the rotation axis 22*d* of the output shaft 12*d*. In particular, the second eccentric force introduction point 30*d* is eccentric with respect to the rotation axis 26*d* of the clamping element 20*d*, as viewed in the axial direction of the output shaft 12*d*. Force is also introduced eccentrically into the second force introduction point 30*d*. Force is introduced parallel to the rotation axis 22*d* of the output shaft 12*d*. Force is introduced directly by the actuating element 58*d* of the operating unit 24*d*. When force is introduced by the actuating element 58*d* the operating element 56*d* at the second eccentric force introduction point 30*d*, the clamping element 20*d* is rotated by the eccentricity, up to a stop that realizes the release position, in which the insert-tool unit 18*d* can be attached or removed. For this purpose, the actuating element 58*d* is routed through the guide cup 72*d*.

Figure 6:
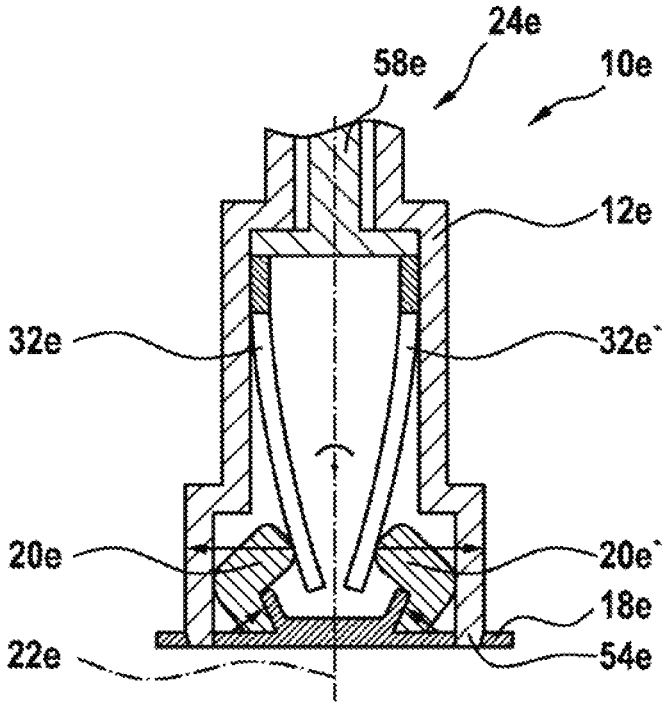

FIG. 6 shows a sectional view of the portable power tool 14*e*, in particular in the region of the transmission housing, and of the quick-change clamping device 10*e*. The quick-change clamping device 10*e*, for a portable power tool 14*e* having an output shaft 12*e* that can be driven in rotation, comprises at least one clamping unit 16*e* which, for the purpose of fixing the insert-tool unit 18*e* to the output shaft 12*e* without the use of tools, has at least one movably mounted clamping element 20*e*, 20*e*', for applying a clamping force to the insert-tool unit 18*e* when the clamping elements 20*e*, 20*e*' are in a clamping position. The quick-change clamping device 10*e* additionally comprises at least one operating unit 24*e*, for moving the at least one clamping element 20*e*, 20*e*' into a clamping position, and/or into a release position of the clamping element 20*e*, 20*e*' in which the insert-tool unit 18*e* can be removed from the clamping unit 16*e* and/or from the output shaft 12*e*. The clamping unit 16*e* comprises two movably mounted clamping elements 20*e*, 20*e*'. The two clamping elements 20*e*, 20*e*' are swivel-mounted. The rotation axes of the two clamping elements 20*e*, 20*e*' are at least substantially perpendicular to the rotation axis 22*e* of the output shaft 12*e*. The two clamping elements 20*e*, 20*e*' are designed, in particular when the two clamping elements 20*e*, 20*e* are in the clamping position, to fix the insert-tool unit 18*e*, when having been arranged on the clamping unit 16*e* and/or on the output shaft 12*e*, axially on the output shaft 12*e*.

The operating unit 24*e* is preferably designed to move the clamping element 20*e* at least into the release position, in which the insert-tool unit 18*e* can be removed from the clamping unit 16*e* and/or from the output shaft 12*e*. The operating unit 24*e* comprises an operating element, which can be actuated by an operator. The operating element is realized as an operating lever. The operating element comprises an eccentric portion for actuation of an actuating element 58*e* of the operating unit 24*e*. The actuating element 58*e* is mounted so as to be translationally movable along the rotation axis 22*e*, in particular in the output shaft 12*e* and/or in the transmission housing. The operating unit 24*e* additionally has at least one spring element 32*e*, 32*e*', designed to directly apply a force to the clamping elements 20*e*, 20*e*', in at least one operating state, substantially perpendicularly in relation to the rotation axis 22*e* of the output shaft 12*e*. The operating unit 24*e* has two spring elements 32*e*, 32*e*', designed to directly apply a force to the clamping elements 20*e*, 20*e*', substantially perpendicularly in relation to the rotation axis 22*e* of the output shaft 12*e*. The spring elements 32*e*, 32*e*' form a part of the actuating element 58*e*. The spring elements 32*e*, 32*e*' form arm-type extensions of the actuating element 58*e* that are designed to directly deflect the clamping elements 20*e*, 20*e*'. The spring elements 32*e*, 32*e*' have at least one sub-region made of a resilient material. The clamping elements 20*e*, 20*e*' are tilted into the clamping position by means of the spring elements 32*e*, 32*e*'. When the actuating element 58*e* is in a non-actuated state, load is applied continuously to the clamping elements 20*e*, 20*e*' by the spring elements 32*e*, 32*e*'. An axial actuation of the actuating element 58*e* by the operating element causes the actuating element 58*e*, and thus also the spring elements 32*e*, 32*e*', to be displaced in the direction of the clamping elements 20*e*, 20*e*'. The spring elements 32*e*, 32*e*' in this case are pushed against ramps, not shown further, on an inner side of the output shaft 12*e*, which deflect the spring elements 32*e*, 32*e*' radially inward. As a result, in an actuated state the spring elements 32*e*, 32*e*' are externally in contact with the clamping elements 20*e*, 20*e*'. In the absence of actuation of the actuating element 58*e*, the actuating element 58*e* is pushed back into an initial position by the spring force of the spring elements 32*e*, 32*e*' that acts on the ramps.

Figure 7:
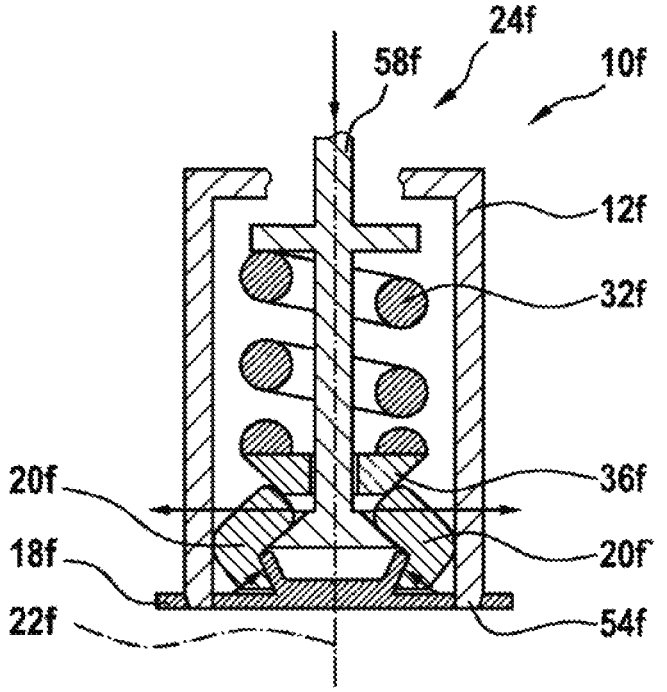

FIG. 7 shows a sectional view of the portable power tool 14*f*, in particular in the region of the transmission housing, and of the quick-change clamping device 10*f*. The quick-change clamping device 10*f*, for a portable power tool 14*f* having an output shaft 12*f* that can be driven in rotation, comprises at least one clamping unit 16*f* which, for the purpose of fixing the insert-tool unit 18*f* to the output shaft 12*f* without the use of tools, has at least one movably mounted clamping element 20*f*, 20*f*', for applying a clamping force to the insert-tool unit 18*f* when the clamping element 20*f*, 20*f*' is in a clamping position. The quick-change clamping device 10*f* additionally comprises at least one operating unit 24*f*, for moving the at least one clamping element 20*f*, 20*f'* into a clamping position, and/or into a release position of the clamping element 20*f*, 20*f'* in which the insert-tool unit 18*f* can be removed from the clamping unit 16*f* and/or from the output shaft 12*f*. The clamping unit 16*f* comprises two movably mounted clamping elements 20*f*, 20*f'*. The two clamping elements 20*f*, 20*f'* are swivel-mounted. The rotation axes of the two clamping elements 20*f*, 20*f'* are each at least substantially perpendicular to the rotation axis 22*f* of the output shaft 12*f*.

The operating unit 24*f* is preferably designed to move the clamping element 20*f* at least into the release position, in which the insert-tool unit 18*f* can be removed from the clamping unit 16*f* and/or from the output shaft 12*f*. The operating unit 24*f* comprises an operating element, which can be actuated by an operator. The operating element is realized as an operating lever. The operating element comprises an eccentric portion for actuation of an actuating element 58*f* of the operating unit 24*f*. The actuating element 58*f* is mounted so as to be translationally movable along the rotation axis 22*f*, in particular in the output shaft 12*f* and/or in the transmission housing.

The clamping unit 16*f* additionally has a spring element 32*f*, which is designed to move the clamping elements 20*f*, 20*f'* into a clamping position. The spring element 32*f* is formed by a coil spring. An upper end of the spring element 32*f* is supported on a flange of the actuating element 58*f*. Furthermore, the clamping unit 16*f* has a deflection element 36*f*, which is designed to deflect a force of the spring element 32*f* into a direction that is at least substantially perpendicular to the rotation axis 22*f* of the output shaft 12*f*. The spring element 32*f* is designed to exert a spring force parallel to the rotation axis 22*f* of the output shaft 12*f*, the deflection element 36*f* being designed to deflect the force of the spring element 32*f* by 90°. A deflection by the deflection element 36*f* is realized in this case by means of a wedge-shaped portion on the deflection element 36*f*. The deflection element 36*f* is formed by a ring having a triangular cross section. The deflection element 36*f* is arranged at an end of the spring element 32*f* that is opposite to the flange of the actuating element 58*f*. In a non-actuated state, an upper plane of the clamping elements 20*f*, 20*f'* is deflected radially outward, into a clamping position, by means of the deflection element 36*f*.

Furthermore, a deflection element 74*f*, which is mirror-inverted with respect to the deflection element 36*f* and bearing against which is an upper end of the clamping elements 20*f*, 20*f'*, is fixedly arranged at a lower, free end of the actuating element 58*f*. The upper ends of the clamping elements 20*f*, 20*f'* are pressed against the deflection element 74*f* by the deflection element 36*f*. Actuation of the actuating element 58*f* causes the deflection element 74*f* to be pushed downward, as a result of which the upper ends of the clamping elements 20*f*, 20*f'* swivel radially inward. The clamping elements 20*f*, 20*f'* are thereby swiveled into a release position.

Figure 8:
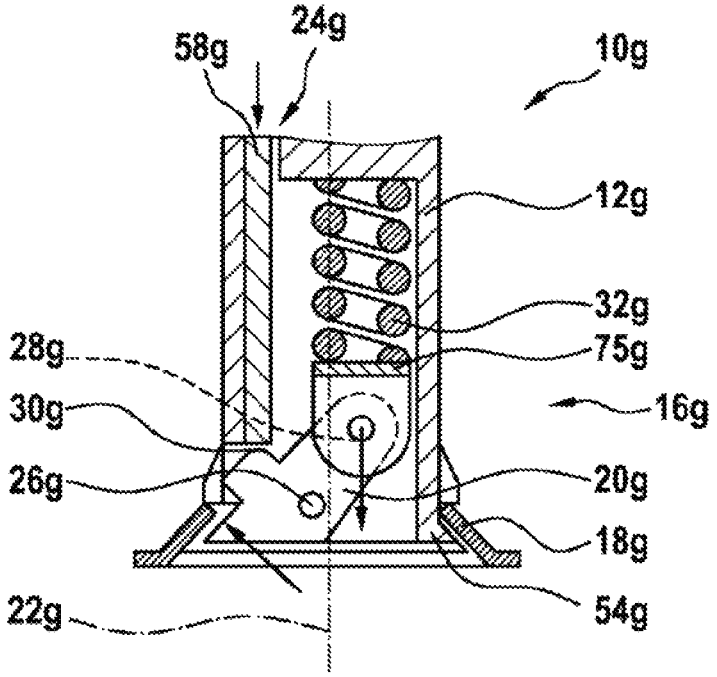

FIG. 8 shows a sectional view of the portable power tool 14*g*, in particular in the region of the transmission housing, and of the quick-change clamping device 10*g*. The quick-change clamping device 10*g*, for a portable power tool 14*g* having an output shaft 12*g* that can be driven in rotation, comprises at least one clamping unit 16*g* which, for the purpose of fixing the insert-tool unit 18*g* to the output shaft 12*g* without the use of tools, has at least one movably mounted clamping element 20*g*, for applying a clamping force to the insert-tool unit 18*g* when the clamping element 20*g* is in a clamping position. The quick-change clamping device 10*g* additionally comprises at least one operating unit 24*g*, for moving the at least one clamping element 20*g* into a clamping position, and/or into a release position of the clamping element 20*g* in which the insert-tool unit 18*g* can be removed from the clamping unit 16*g* and/or from the output shaft 12*g*. The clamping element 20*g* is swivel-mounted. A rotation axis 26*g* of the clamping element 20*g* is at least substantially perpendicular to the rotation axis 22*g* of the output shaft 12*g*. The clamping element 20*g* is formed by a toggle lever mounted so as to be rotatable about a rotation axis 26*g* that is perpendicular to the rotation axis 22*g* of the output shaft 12*g*. The clamping element 20*g* is connected to the output shaft 12*g*. The rotation axis 26*g* of the clamping element 20*g* is fixedly connected to the output shaft 12*g*. The clamping element 20*g* can be driven in rotation, together with the output shaft 12*g*, about the rotation axis 22*g*. The clamping element 20*g* is formed by a positive-engagement element that is movable transversely in relation to the rotation axis 22*g* of the output shaft 12*g*. In addition, the clamping element 20*g* is designed to engage with positive engagement behind at least a sub-region of the insert-tool unit 18*g* for the purpose of securing the insert-tool unit 18*g*. For this purpose, the clamping element 20*g* has a hook-shaped extension that, when the clamping element 20*g* is in a clamping position, engages with positive engagement behind a sub-region of the insert-tool unit 18*g*.

The operating unit 24*g* is preferably designed to move the clamping element 20*g* at least into the release position, in which the insert-tool unit 18*g* can be removed from the clamping unit 16*g* and/or from the output shaft 12*g*. The operating unit 24*g* comprises an operating element, which can be actuated by an operator. The operating element is realized as an operating lever. The operating element comprises an eccentric portion for actuation of an actuating element 58*g* of the operating unit 24*g*. The actuating element 58*g* is mounted so as to be translationally movable along the rotation axis 22*g*, in particular in the output shaft 12*g* and/or in the transmission housing.

The clamping element 20*g* additionally has a first eccentric force introduction point 28*g*. The first eccentric force introduction point 28*g* is eccentric with respect to the rotation axis 26*g* of the clamping element 20*g*. The first eccentric force introduction point 28*g* is both eccentric with respect to the rotation axis 26*g* of the clamping element 20*g* and eccentric with respect to the rotation axis 22*g* of the output shaft 12*g*. The first eccentric force introduction point 28*g* is eccentric with respect to the rotation axis 26*g* of the clamping element 20*g*, as viewed in the axial direction of the output shaft 12*g*. In addition, force is also introduced eccentrically into the force introduction point 28*g*. Force is introduced parallel to the rotation axis 22*g* of the output shaft 12*g*. For the purpose of rotating the clamping element 20*g* into a clamping position, a spring force acts upon the first eccentric force introduction point 28*g*, in at least one operating state. Introduction of force to the clamping element 20*g* is effected, in the first force introduction point 28*g*, by a spring element 32*g*. The spring element 32*g* is formed by a coil spring. In principle, however, a different design of the spring element 32*g*, considered appropriated by persons skilled in the art, would also be conceivable. The spring element 32*g* is designed to exert a spring force upon the clamping element 20*g*, which moves the clamping element 20*g* into a clamping position and/or holds it in a clamping position. When force is introduced by the spring element 32*g* at the first eccentric force introduction point 28*g*, the clamping element 20*g* is rotated by the eccentricity, up to a stop that realizes the clamping position. For precise application of force, there is an intermediate plate 75*g*, which is connected to an end of the clamping element 20*g* via a rotation axis, arranged between the clamping element 20*g* and the spring element 32*g*. By means of the operating unit 24*g*, the clamping element 20*g* can be moved, contrary to the spring force of the spring element 32*g*, into the release position, in which the clamping element 20*g* does not engage behind the insert-tool unit 18*g*. The operating unit 24*g* is designed, for the purpose of rotating clamping element 20*g* into the release position, to act upon a second eccentric force introduction point 30*g*, which is spaced apart from the first eccentric force introduction point 28*g*.

The second eccentric force introduction point 30*g* is arranged on a side of the rotation axis 26*g* of the clamping element 20*g* that is opposite to the first eccentric force introduction point 28*g*. In addition, the second eccentric force introduction point 30*g*, for the purpose of rotating the clamping element 20*g*, is provided in a direction opposite to that of the first eccentric force introduction point 28*g*. The second eccentric force introduction point 30*g* is eccentric with respect to the rotation axis 26*g* of the clamping element 20*g* and with respect to the rotation axis 22*g* of the output shaft 12*g*. In particular, the second eccentric force introduction point 30*g* is eccentric with respect to the rotation axis 26*g* of the clamping element 20*g*, as viewed in the axial direction of the output shaft 12*g*. Force is also introduced eccentrically into the second force introduction point 30*g*. Force is introduced parallel to the rotation axis 22*g* of the output shaft 12*g*. Force is introduced directly by the actuating element 58*g* of the operating unit 24*g*. When force is introduced by the actuating element 58*g*, via the operating element 56*g*, at the second eccentric force introduction point 30*g*, the clamping element 20*g* is rotated by the eccentricity, up to a stop that realizes the release position, in which the insert-tool unit 18*g* can be attached or removed.

Figure 9:
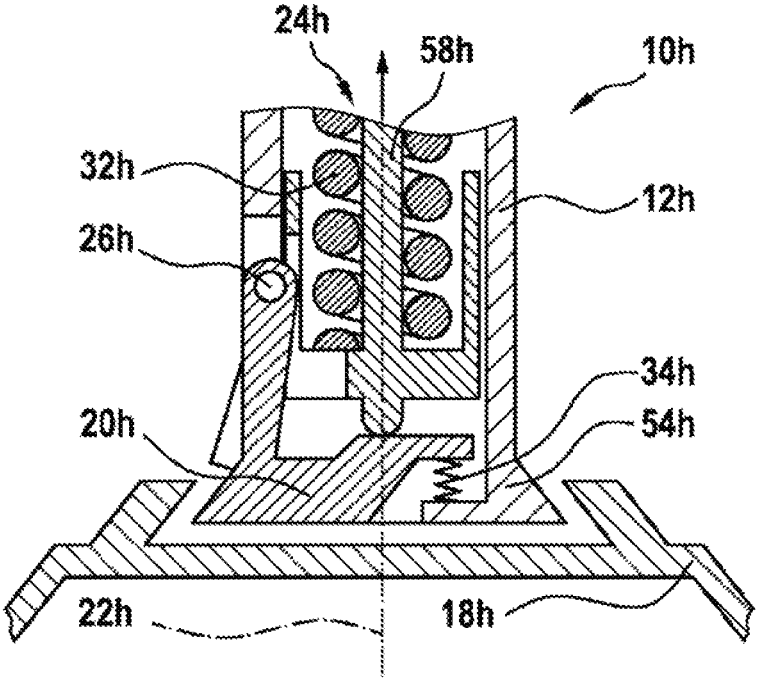

FIG. 9 shows a sectional view of the portable power tool 14*h*, in particular in the region of the transmission housing, and of the quick-change clamping device 10*h*. The quick-change clamping device 10*h*, for a portable power tool 14*h* having an output shaft 12*h* that can be driven in rotation, comprises at least one clamping unit 16*h* which, for the purpose of fixing the insert-tool unit 18*h* to the output shaft 12*h* without the use of tools, has at least one movably mounted clamping element 20*h*, for applying a clamping force to the insert-tool unit 18*h* when the clamping element 20*h* is in a clamping position. The quick-change clamping device 10*h* additionally comprises at least one operating unit 24*h*, for moving the at least one clamping element 20*h* into a clamping position, and/or into a release position of the clamping element 20*h* in which the insert-tool unit 18*h* can be removed from the clamping unit 16*h* and/or from the output shaft 12*h*. The clamping element 20*h* is swivel-mounted. A rotation axis 26*h* of the clamping element 20*h* is at least substantially perpendicular to the rotation axis 22*h* of the output shaft 12*h*. The clamping element 20*h* is formed by a toggle lever mounted so as to be rotatable about a rotation axis 26*h* that is perpendicular to the rotation axis 22*h* of the output shaft 12*h*. The rotation axis 22*h* is arranged on a circumference of the output shaft 12*h*. The clamping elements 20*h* is formed by a positive-engagement element that is movable transversely in relation to the rotation axis 22*h* of the output shaft 12*h*.

The operating unit 24*h* is designed to move the clamping element 20*h* at least into the release position, in which the insert-tool unit 18*h* can be removed from the clamping unit 16*h* and/or from the output shaft 12*h*. The operating unit 24*h* comprises an operating element, which can be actuated by an operator. The operating element comprises an eccentric portion for actuation of an actuating element 58*h* of the operating unit 24*h*. The actuating element 58*h* is mounted so as to be translationally movable along the rotation axis 22*h*, in particular in the output shaft 12*h* and/or in the transmission housing. The actuating element 58*h* is realized in the form of a cup at a free end. The actuating element 58*h* additionally has an extension that is designed for contacting the clamping element 20*h*. The clamping element 20*h* is pressed against the extension from below by a second spring element 34*h*, which is supported on the output shaft 12*h*. In addition, the actuating element 58*h* is pressed axially against the clamping element 20*h* from above by a first spring element 32*h*, which is supported on the output shaft 12*h*. The clamping unit 16*h* comprises the first spring element 32*h*, which is designed to move the clamping element 20*h* into a clamping position, and the second spring element 34*h*, which is weaker than the first spring element 32*h* and which is designed to move the one clamping element 20*h* into a release position. When the actuating element 58*h* is in a non-actuated state, the clamping element 20*h* is rotated into a clamping position by the stronger, first spring element 32*h*, by means of the extension of the actuating element 58*h*. If the actuating element 58*h* is actuated, i.e. in this case pulled upward, the first spring element 32*h* is contracted by the operator, and the extension is raised from the clamping element 20*h*, such that the second spring element 34*h* rotates the clamping element 20*h*, guided by the extension, into the release position.

Figure 10:
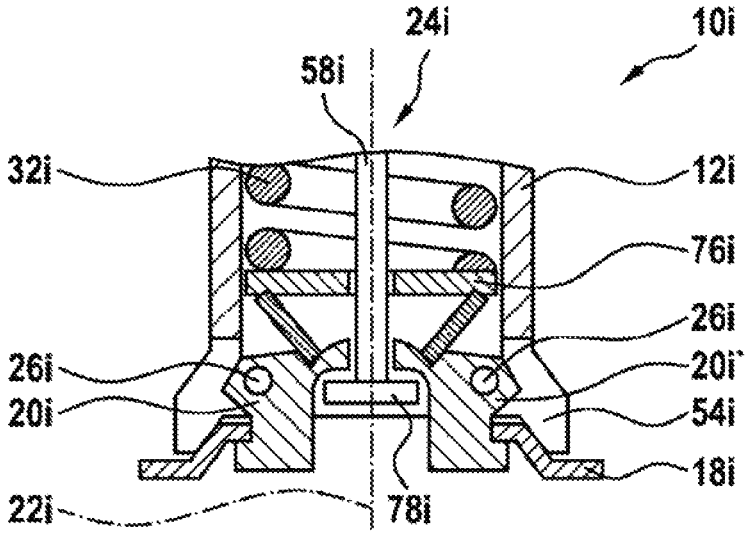

FIG. 10 shows a sectional view of the portable power tool 14*i*, in particular in the region of the transmission housing, and of the quick-change clamping device 10*i*. The quick-change clamping device 10*i*, for a portable power tool 14*i* having an output shaft 12*i* that can be driven in rotation, comprises at least one clamping unit 16*i* which, for the purpose of fixing the insert-tool unit 18*i* to the output shaft 12*i* without the use of tools, has at least one movably mounted clamping element 20*i*, 20*i*', for applying a clamping force to the insert-tool unit 18*i* when the clamping element 20*i*, 20*i*' is in a clamping position. The quick-change clamping device 10*i* additionally comprises at least one operating unit 24*i*, for moving the at least one clamping element 20*i*, 20*i*' into a clamping position, and/or into a release position of the clamping element 20*i*, 20*i*' in which the insert-tool unit 18*i* can be removed from the clamping unit 16*i* and/or from the output shaft 12*i*. The clamping unit 16*i* comprises two movably mounted clamping elements 20*i*, 20*i*'. The two clamping elements 20*i*, 20*i*' are swivel-mounted. The rotation axes 26*i*, 26*i*' of the two clamping elements 20*i*, 20*i*' are each at least substantially perpendicular to the rotation axis 22*i* of the output shaft 12*i*.

The operating unit 24*i* is preferably designed to move the clamping element 20*i* at least into the release position, in which the insert-tool unit 18*i* can be removed from the clamping unit 16*i* and/or from the output shaft 12*i*. The operating unit 24*i* comprises an operating element, which can be actuated by an operator. The operating element is realized as an operating lever. The operating element comprises an eccentric portion for actuation of an actuating element 58*i* of the operating unit 24*i*. The actuating element 58*i* is mounted so as to be translationally movable along the rotation axis 22*i*, in particular in the output shaft 12*i* and/or in the transmission housing.

The clamping unit 16*i* additionally has a spring element 32*i*, which is designed to move the clamping elements 20*i*, 20*i*' into a clamping position. The spring element 32*i* is formed by a coil spring. An upper end of the spring element 32*i* is supported in the output shaft 12*i*. Furthermore, the clamping unit 16*i* has a transmission ring 76*i*, which is designed to transmit an axial force of the spring element 32*i* to the clamping elements 20*i*, 20*i*'. In a non-actuated state, an upper plane of the clamping elements 20*i*, 20*i*' is deflected axially downward by means of the deflection element 36*i*, and thus the clamping elements 20*i*, 20*i*' are brought into a clamping position.

Furthermore, a flange 78*i*, on which there rests an upper end of the clamping elements 20*i*, 20*i*', is fixedly arranged at a lower, free end of the actuating element 58*i*. The upper ends of the clamping elements 20*i*, 20*i*' are pressed against the flange 78*i* by the transmission ring 76*i*. Actuation of the actuating element 58*i*, i.e. in this case pulling of the actuating element 58*i* upward, causes the upper ends of the clamping elements 20*i*, 20*i*' to be pulled upward, contrary to the spring force of the spring element 32*i*, by means of the flange 78*i*, and thus swiveled upward. The clamping elements 20*i*, 20*i*' are thereby swiveled into a release position.

Figure 11:
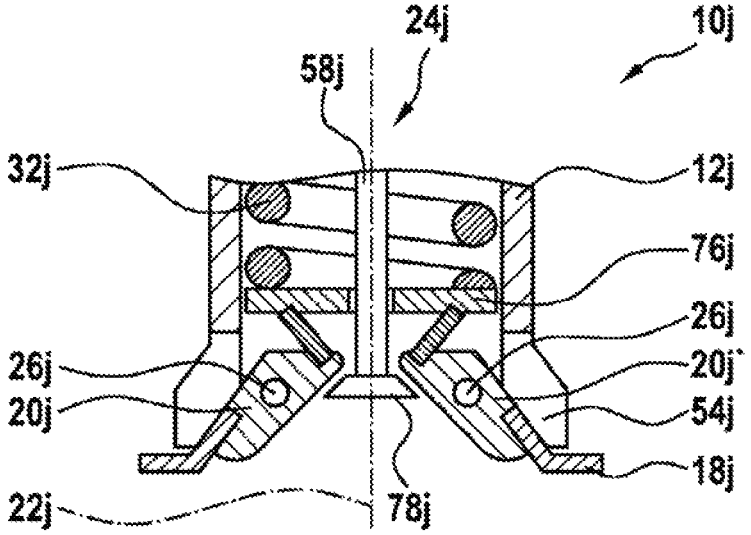
Figure 12:
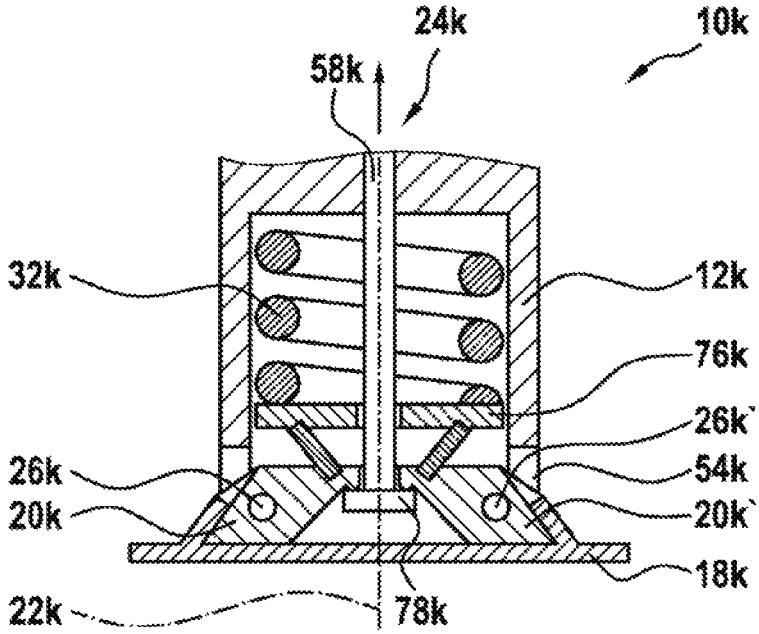

FIGS. 11 and 12 each show alternative forms of the clamping elements 20*j*, 20*j*'; 20*k*, 20*k*', as compared to FIG. 10, a functionality corresponding substantially to the functionality described in FIG. 10.

Figure 13:
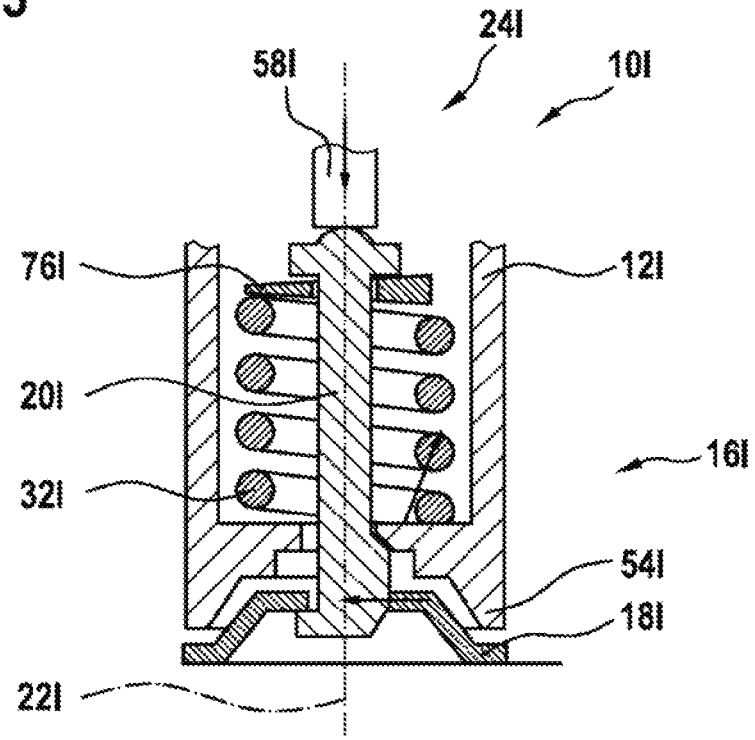

FIG. 13 shows a sectional view of the portable power tool 14*l*, in particular in the region of the transmission housing, and of the quick-change clamping device 10*l*. The quick-change clamping device 10*l*, for a portable power tool 14*l* having an output shaft 12*l* that can be driven in rotation, comprises at least one clamping unit 16*l* which, for the purpose of fixing the insert-tool unit 18*l* to the output shaft 12*l* without the use of tools, has at least one movably mounted clamping element 20*l*, for applying a clamping force to the insert-tool unit 18*l* when the clamping element 20*l* is in a clamping position. The quick-change clamping device 10*l* additionally comprises at least one operating unit 24*l*, for moving the clamping element 20*l* into a clamping position, and/or into a release position of the clamping element 20*l* in which the insert-tool unit 18*l* can be removed from the clamping unit 16*l* and/or from the output shaft 12*l*. The clamping element 20*l* is partially swivel-mounted. The clamping element 20*l* is substantially parallel to a rotation axis 22*l* of the output shaft 12*l*. The clamping element 20*l* is held freely in the output shaft 12*l*. In addition, the clamping element 20*l* is spring-loaded by means of a spring element 32*l*. A lower end of the spring element 32*l* is supported on a base of an interior of the output shaft 12*l*, and an upper end thereof is supported on a transmission ring 76*l*. The transmission ring 76*l*, in turn, is supported on a flange arranged at an upper end of the clamping element 20*l*, and transmits a spring force of the spring element 32*l* to the clamping element 20*l*. The clamping element 20*l* extends through the spring element 32*l*, along a spring axis of the spring element 32*l*. Furthermore, a lower end of the clamping element 20*l*, which is designed to engage with positive engagement behind the insert-tool unit 18*l*, is routed through a recess in the base of the interior of the output shaft 12*l*.

The clamping unit 16*l* additionally has at least one ramp 40*l*, which is designed to deflect at least a sub-region of the clamping element 20*l* differently, in dependence on an axial position, perpendicularly in relation to the rotation axis 22*l* of the output shaft 12*l*. A lower, free end of the clamping element 20*l* is swiveled differently, by means of the ramp 40*l*, in dependence on an axial position, relative to the rotation axis 22*l* of the output shaft 12*l*. The ramp 40*l* is arranged both on a spindle cup of the output shaft 12*b* and on the clamping element 20*l*. The clamping element 16*l* has two ramps 40*l*. One is on an inner surface of the recess, in the base of the interior of the output shaft 12*l*, and one is on an outer surface of the clamping element 20*l*, at the level of the recess, in the base of the interior of the output shaft 12*l*. The ramps 40*l* are designed to act directly between the clamping element 20*l* and the output shaft 12*l*. The ramps 40*l* form a contact surface between the clamping element 20*l* and the output shaft 12*l*. The ramps 40*l* in this case are inclined in relation to the rotation axis 22*l* of the output shaft 12*l*.

The operating unit 24*l* is designed to move the clamping element 20*l* at least into the release position, in which the insert-tool unit 18*l* can be removed from the clamping unit 16*l* and/or from the output shaft 12*l*. The operating unit 24*l* comprises an operating element, which can be actuated by an operator. The operating element comprises an eccentric portion for actuation of an actuating element 58*l* of the operating unit 24*l*. The actuating element 58*l* is mounted so as to be translationally movable along the rotation axis 22*l*, in particular in the output shaft 12*l* and/or in the transmission housing. In a non-actuated state, the spring element 32*l* is maximally deflected and displaces the clamping element 20*l* axially upward. The ramps 40*l* cause a lower end of the clamping element 20*l* in this position to be swiveled radially outward. In this position, the clamping element 20*l* is in the clamping position. The actuating element 58*l* acts directly upon the clamping element 20*l*. Upon actuation of the actuating element 58*l*, the clamping element 20*l* is pushed axially downward, contrary to the spring force of the spring element 32*l*. The ramps 40*l* cause a lower end of the clamping element 20*l* in this position to be swiveled radially inward. In this position, the clamping element 20*l* is in the release position.

Figure 14:
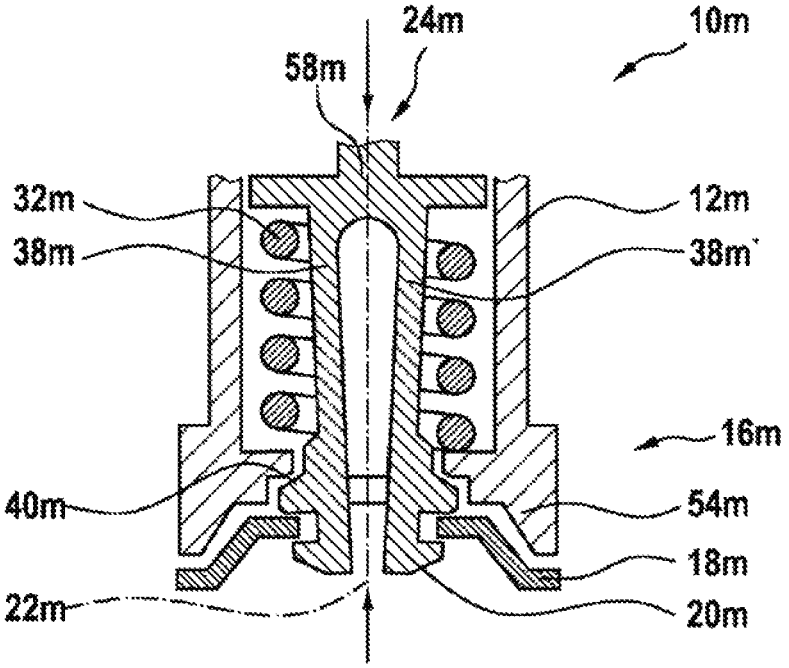

FIG. 14 shows a sectional view of the portable power tool 14*m*, in particular in the region of the transmission housing, and of the quick-change clamping device 10*m*. The quick-change clamping device 10*m*, for a portable power tool 14*m* having an output shaft 12*m* that can be driven in rotation, comprises at least one clamping unit 16*m* which, for the purpose of fixing the insert-tool unit 18*m* to the output shaft 12*m* without the use of tools, has at least one movably mounted clamping element 20*m*, for applying a clamping force to the insert-tool unit 18*m* when the clamping element 20*m* is in a clamping position. The quick-change clamping device 10*m* additionally comprises at least one operating unit 24*m*, for moving the clamping element 20*m* into a clamping position, and/or into a release position of the clamping element 20*m* in which the insert-tool unit 18*m* can be removed from the clamping unit 16*m* and/or from the output shaft 12*m*.

The clamping element 20*m* has at least one resilient sub-section 38*m*, 38*m*' that, for the purpose of receiving the insert-tool unit 18*m* with positive engagement, is designed at least to be deflected substantially perpendicularly in relation to the rotation axis 22*m* of the output shaft 12*m*. The clamping element 20*m* has two resilient sub-sections 38*m*, 38*m*'. The resilient sub-sections 38*m*, 38*m*', for the purpose of receiving the insert-tool unit 18*m* with positive engagement, are designed to be deflected substantially perpendicularly in relation to the rotation axis 22*m* of the output shaft 12*m* and radially in a direction away from the rotation axis 22*m*. The resilient sub-sections 38*m*, 38*m*', for the purpose of releasing the insert-tool unit 18*m*, are additionally designed to be deflected substantially perpendicularly in relation to the rotation axis 22*m* of the output shaft 12*m* and radially in a direction toward the rotation axis 22*m*. The clamping element 20*m* is realized in the manner of a clamp having at least two elongated extensions, which form the resilient sub-sections 38*m*, 38*m*'. The clamping element 20*m* is partially U-shaped, the two free ends forming the resilient sub-sections 38*m*, 38*m*'. In addition, the clamping element 20*m* is spring-loaded by means of a spring element 32*m*. A lower end of the spring element 32*m* is supported on a base of an interior of the output shaft 12*m*, and an upper end thereof is supported on a flange of the clamping element 20*m*. The clamping element 20*m* extends through the spring element 32*m*, along a spring axis of the spring element 32*m*. Furthermore, the resilient sub-sections 38*m*, 38*m*' of the clamping element 20*m*, which are designed to engage with positive engagement behind the insert-tool unit 18*m*, are routed through a recess in the base of the interior of the output shaft 12*m*.

The clamping unit 16*m* additionally has at least one ramp 40*m*, which is designed to deflect a sub-region of the clamping element 20*m* differently, in dependence on an axial position, perpendicularly in relation to the rotation axis 22*m* of the output shaft 12*m*. The resilient sub-sections 38*m*, 38*m*' are swiveled differently, by means of the ramp 40*m*, in dependence on an axial position, relative to the rotation axis 22*m* of the output shaft 12*m*. The ramp 40*m* is arranged both on a spindle cup of the output shaft 12*b* and on the clamping element 20*m*. The clamping element 16*m* has two ramps 40*m*. One is on an inner surface of the recess, in the base of the interior of the output shaft 12*m*, and one is on an outer surface of the resilient sub-sections 38*m*, 38*m*' of the clamping element 20*m*, at the level of the recess, in the base of the interior of the output shaft 12*m*. The ramps 40*m* are designed to act directly between the clamping element 20*m* and the output shaft 12*m*. The ramps 40*m* form a contact surface between the clamping element 20*m* and the output shaft 12*m*. The ramps 40*m* in this case are inclined in relation to the rotation axis 22*m* of the output shaft 12*m*.

The operating unit 24*m* is designed to move the clamping element 20*m* at least into the release position, in which the insert-tool unit 18*m* can be removed from the clamping unit 16*m* and/or from the output shaft 12*m*. The operating unit 24*m* comprises an operating element, which can be actuated by an operator. The operating element comprises an eccentric portion for actuation of an actuating element 58*m* of the operating unit 24*m*. The actuating element 58*m* is mounted so as to be translationally movable along the rotation axis 22*m*, in particular in the output shaft 12*m* and/or in the transmission housing. The actuating element 58*m* is integral with the clamping element 20*m*. In a non-actuated state, the spring element 32*m* is maximally deflected and displaces the clamping element 20*m* axially upward. The ramps 40*m* cause the resilient sub-sections 38*m*, 38*m*' in this position to be swiveled radially outward. In this position, the clamping element 20*m* is in the clamping position. The actuating element 58*m* acts directly upon the clamping element 20*m*. Upon actuation of the actuating element 58*m*, the clamping element 20*m* is pushed axially downward, contrary to the spring force of the spring element 32*m*. The ramps 40*m* cause the resilient sub-sections 38*m*, 38*m*' in this position to be swiveled radially inward. In this position, the clamping element 20*m* is in the release position.

Figure 15:
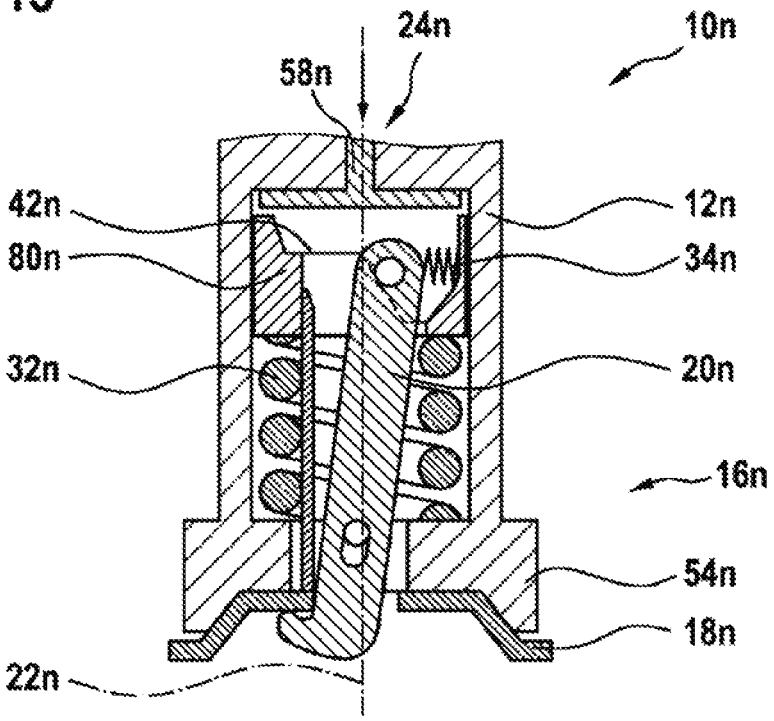

FIG. 15 shows a sectional view of the portable power tool 14*n*, in particular in the region of the transmission housing, and of the quick-change clamping device 10*n*. The quick-change clamping device 10*n*, for a portable power tool 14*n* having an output shaft 12*n* that can be driven in rotation, comprises at least one clamping unit 16*n* which, for the purpose of fixing the insert-tool unit 18*n* to the output shaft 12*n* without the use of tools, has at least one movably mounted clamping element 20*n*, for applying a clamping force to the insert-tool unit 18*n* when the clamping element 20*n* is in a clamping position. The quick-change clamping device 10*n* additionally comprises at least one operating unit 24*n*, for moving the clamping element 20*n* into a clamping position, and/or into a release position of the clamping element 20*n* in which the insert-tool unit 18*n* can be removed from the clamping unit 16*n* and/or from the output shaft 12*n*. The clamping element 20*n* is swivel-mounted. A rotation axis 26*n* of the clamping element 20*n* is at least substantially perpendicular to the rotation axis 22*n* of the output shaft 12*n*. The clamping element 20*n* is formed by a toggle lever mounted so as to be rotatable about a rotation axis 26*n* that is perpendicular to the rotation axis 22*n* of the output shaft 12*n*. The clamping element 20*n* is partially displaceable with respect to the rotation axis 22*n*. The clamping element 20*n* is substantially parallel to a rotation axis 22*n* of the output shaft 12*n*. In addition, the clamping element 20*n* is indirectly spring-loaded by means of a spring element 32*n*. A lower end of the spring element 32*n* is supported on a base of an interior of the output shaft 12*n*, and an upper end thereof is supported on a coulisse element 80*n*. The coulisse element 80*n* is mounted in an axially displaceable manner in the output shaft 12*n*. The coulisse element 80*n* comprises a coulisse 42*n*. The coulisse 42*n* extends substantially transversely in relation to the rotation axis 22*n* of the output shaft 12*b*. One end of the clamping element 20*n* is routed in the coulisse 42*n*, which is mounted so as to be movable relative to the rotation axis 26*n* of the clamping element 20*n*. An end of the clamping element 20*n* that faces away from the insert-tool unit 18*n* is routed directly in the coulisse 42*n*. The operating unit 24*e* additionally has a second spring element 34*n*, designed to directly apply a force to the clamping element 20*n*, in at least one operating state, substantially perpendicularly in relation to the rotation axis 22*n* of the output shaft 12*n*. The second spring element 34*n* is clamped, transversely in relation to the rotation axis 22*n* of the output shaft 12*n*, between the coulisse element 80*n* and the clamping element 20*n*.

The operating unit 24*n* is designed to move the clamping element 20*n* at least into the release position, in which the insert-tool unit 18*n* can be removed from the clamping unit 16*n* and/or from the output shaft 12*n*. The operating unit 24*n* comprises an operating element, which can be actuated by an operator. The operating element comprises an eccentric portion for actuation of an actuating element 58*n* of the operating unit 24*n*. The actuating element 58*n* is mounted so as to be translationally movable along the rotation axis 22*n*, in particular in the output shaft 12*n* and/or in the transmission housing. The actuating element 58*n* is designed to act directly upon the coulisse element 80*n*, and displace it axially. In a non-actuated state, the spring element 32*n* is maximally deflected and displaces the coulisse element 80*n* axially upward. Owing to the coulisse 42*n*, the upper end of the clamping element 20*n* slides radially outward in the coulisse 42*n*, contrary to the spring force of the second spring element 34*n*, as a result of which a lower end of the clamping element 20*n* is likewise swiveled radially outward, about the rotation axis 26*n*. In this position, the clamping element 20*n* is in the clamping position. Upon actuation of the actuating element 58*n*, the coulisse element 80*n* is pushed axially downward, contrary to the spring force of the spring element 32*n*. Owing to the second spring element 34*n*, the upper end of the clamping element 20*n* is pushed radially inward in the coulisse 42*n*, as a result of which a lower end of the clamping element 20*n* is swiveled radially inward, about the rotation axis 26*n*. In this position, the clamping element 20*n* is in the release position.

Figure 16:
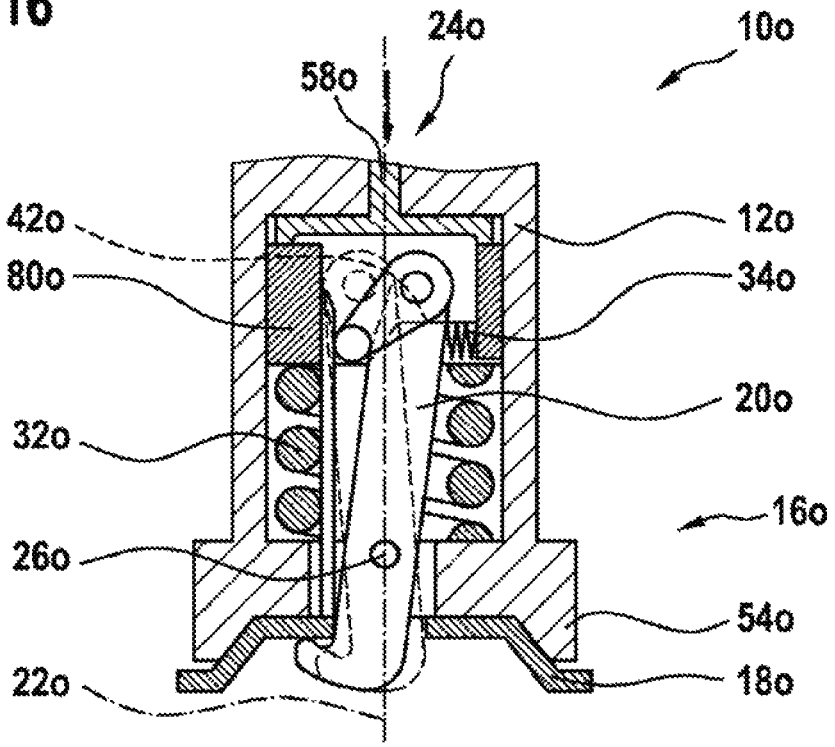

FIG. 16 shows a sectional view of the portable power tool 140, in particular in the region of the transmission housing, and of the quick-change clamping device 10*o*. The quick-change clamping device 10*o*, for a portable power tool 14*o* having an output shaft 12*o* that can be driven in rotation, comprises at least one clamping unit 16*o* which, for the purpose of fixing the insert-tool unit 18*o* to the output shaft 12*o* without the use of tools, has at least one movably mounted clamping element 200, for applying a clamping force to the insert-tool unit 18*o* when the clamping element 20*o* is in a clamping position. The quick-change clamping device 10*o* additionally comprises at least one operating unit 24*o*, for moving the clamping element 20*o* into a clamping position, and/or into a release position of the clamping element 20*o* in which the insert-tool unit 18*o* can be removed from the clamping unit 16*o* and/or from the output shaft 12*o*. The clamping element 20*o* is swivel-mounted. A rotation axis 26*o* of the clamping element 20*o* is at least substantially perpendicular to the rotation axis 22*o* of the output shaft 12*o*. The clamping element 20*o* is formed by a toggle lever mounted so as to be rotatable about a rotation axis 26*o* that is perpendicular to the rotation axis 22*o* of the output shaft 12*o*. The clamping element 200 is partially displaceable with respect to the rotation axis 220. The clamping element 200 is substantially parallel to a rotation axis 22*o* of the output shaft 12*o*. In addition, the clamping element 200 is indirectly spring-loaded by means of a spring element 320. A lower end of the spring element 32*o* is supported on a base of an interior of the output shaft 12*o*, and an upper end thereof is supported on a coulisse element 800. The coulisse element 80*o* is mounted in an axially displaceable manner in the output shaft 12*o*. The coulisse element 80*o* comprises a coulisse 42*o*. The coulisse 42*o* extends substantially transversely in relation to the rotation axis 22*o* of the output shaft 12*b*. One end of the clamping element 200 is routed in the coulisse 42*o*, which is mounted so as to be movable relative to the rotation axis 260 of the clamping element 200. An end of the clamping element 200 that faces away from the insert-tool unit 18*o* is routed indirectly in the coulisse 42*o*, via an intermediate lever 82*o*. A free end of the intermediate lever 82*o* is arranged in a depression of the coulisse 42*o*, which serves as a rotation axis. The operating unit 24*e* additionally has a second spring element 34*o*, designed to directly apply a force to the clamping element 200, in at least one operating state, substantially perpendicularly in relation to the rotation axis 22*o* of the output shaft 12*o*. The second spring element 34*o* is clamped, transversely in relation to the rotation axis 22*o* of the output shaft 12*o*, between the coulisse element 800 and the clamping element 20*o*.

The operating unit 24*o* is designed to move the clamping element 20*o* at least into the release position, in which the insert-tool unit 18*o* can be removed from the clamping unit 16*o* and/or from the output shaft 12*o*. The operating unit 24*o* comprises an operating element, which can be actuated by an operator. The operating element comprises an eccentric portion for actuation of an actuating element 58*o* of the operating unit 24*o*. The actuating element 58*o* is mounted so as to be translationally movable along the rotation axis 220, in particular in the output shaft 12*o* and/or in the transmission housing. The actuating element 580 is designed to act directly upon the coulisse element 80*o*, and displace it axially. In a non-actuated state, the spring element 32*o* is maximally deflected and displaces the coulisse element 80*o* axially upward. Owing to the coulisse 420 and the intermediate lever 82*o*, the upper end of the clamping element 20*n* tilts radially outward, contrary to the spring force of the second spring element 34*o*, as a result of which a lower end of the clamping element 20*o* is likewise swiveled radially outward, about the rotation axis 26*o*. In this position, the clamping element 20*o* is in the clamping position. Upon actuation of the actuating element 58*o*, the coulisse element 800 is pushed axially downward, contrary to the spring force of the spring element 32*o*. Owing to the second spring element 34*o*, the upper end of the clamping element 200 is pushed radially inward and the intermediate lever 82*o* is set upright in the coulisse 42*o*, as a result of which a lower end of the clamping element 20*o* is swiveled radially inward, about the rotation axis 26*o*. In this position, the clamping element 20*o* is in the release position.

The invention claimed is:

1. A quick-change clamping device for a portable power tool, comprising:

at least one output shaft configured be driven in rotation; and at least one clamping unit configured to fix an insert-tool unit to the output shaft without use of tools, the clamping unit having at least one movably mounted clamping element configured to apply a clamping force to the insert-tool unit when the clamping element is in a clamping position, wherein the clamping element is formed by a positive-engagement element that is movable transversely in relation to a first rotation axis of the output shaft and that is configured to engage with positive engagement behind at least a sub-region of the insert-tool unit so as to secure the insert-tool unit, and wherein the clamping element includes a toggle lever mounted so as to be rotatable about a second rotation axis that extends in a direction perpendicular to the first rotation axis, the second rotation axis being spaced apart from the first rotation axis;

at least one operating unit configured to move the clamping element into one or more of the clamping position and a release position of the clamping element in which the insert-tool unit is configured to be removed from the clamping unit; and a spring configured, in at least one operating state, to exert a first spring force on at least one first eccentric force introduction point of the clamping element to rotate the clamping element into a clamping position, the at least one first eccentric force introduction point being eccentric with respect to both the first and second rotation axes, wherein the operating unit is configured to act upon a second eccentric force introduction point that is spaced apart from the first eccentric force introduction point so as to rotate the clamping element into a release position.

2. The quick-change clamping device as claimed in claim 1, wherein spring is configured to directly apply the spring force to the clamping element, in the at least one operating state, at least substantially perpendicularly in relation to the first rotation axis.

3. A power tool, comprising:

an output shaft configured to be driven in rotation about a first rotation axis; and a quick-change clamping device including at least one clamping unit configured to fix an insert-tool unit to the output shaft without use of tools, the clamping unit having at least one movably mounted clamping element configured to apply a clamping force to the insert-tool unit when the clamping element is in a clamping position, wherein the clamping element is formed by a positive-engagement element that is movable transversely in relation to the first rotation axis and that is configured to engage with positive engagement behind at least a sub-region of the insert-tool unit so as to secure the insert-tool unit, and wherein the clamping element includes a toggle lever mounted so as to be rotatable about a second rotation axis that extends in a direction perpendicular to the first rotation axis, the second rotation axis being spaced apart from the first rotation axis;

wherein the quick-change clamping device further comprises:

at least one operating unit configured to move the clamping element into one or more of the clamping position and a release position of the clamping element in which the insert-tool unit is configured to be removed from the clamping unit; and a spring configured, in at least one operating state, to exert a first spring force on at least one first eccentric force introduction point of the clamping element to rotate the clamping element into a clamping position, the at least one first eccentric force introduction point being eccentric with respect to both the first and second rotation axes, and wherein the operating unit is configured to act upon a second eccentric force introduction point that is spaced apart from the first eccentric force introduction point so as to rotate the clamping element into a release position.

4. The power tool as claimed in claim 3, wherein the power tool is configured as a power angle grinder.

5. A power tool system, comprising:

an insert-tool unit; and at least one power tool including:

an output shaft configured to be driven in rotation about a first rotation axis, and a quick-change clamping device that includes at least one clamping unit configured to fix the insert-tool unit to the output shaft without use of tools, the clamping unit having at least one movably mounted clamping element configured to apply a clamping force to the insert-tool unit when the clamping element is in a clamping position, wherein the clamping element is formed by a positive-engagement element that is movable transversely in relation to the first rotation axis and that is configured to engage with positive engagement behind at least a sub-region of the insert-tool unit so as to secure the insert-tool unit, and wherein the clamping element includes a toggle lever mounted so as to be rotatable about a second rotation axis that extends in a direction perpendicular to the first rotation axis, the second rotation axis being spaced apart from the first rotation axis, wherein the quick-change clamping device further comprises:

at least one operating unit configured to move the clamping element into one or more of the clamping position and a release position of the clamping element in which the insert-tool unit is configured to be removed from the clamping unit; and a spring configured, in at least one operating state, to exert a first spring force on at least one first eccentric force introduction point of the clamping element to rotate the clamping element into a clamping position, the at least one first eccentric force introduction point being eccentric with respect to both the first and second rotation axes, and wherein the operating unit is configured to act upon a second eccentric force introduction point that is spaced apart from the first eccentric force introduction point so as to rotate the clamping element into a release position.

6. The quick-change clamping device as claimed in claim 1, wherein the portable power tool is configured as a power angle grinder.

* * * * *